US008932029B2

(12) United States Patent
Komatsu

(10) Patent No.: US 8,932,029 B2
(45) Date of Patent: Jan. 13, 2015

(54) ROTARY CYLINDER DEVICE

(75) Inventor: Fumito Komatsu, Shiojiri (JP)

(73) Assignee: Yugen Kaisha K. R & D, Shiojiri-shi (JP)

( * ) Notice: Subject to any disclaimer, the term of this patent is extended or adjusted under 35 U.S.C. 154(b) by 336 days.

(21) Appl. No.: 13/497,088

(22) PCT Filed: Sep. 22, 2010

(86) PCT No.: PCT/JP2010/066436
§ 371 (c)(1),
(2), (4) Date: Mar. 20, 2012

(87) PCT Pub. No.: WO2011/052313
PCT Pub. Date: May 5, 2011

(65) Prior Publication Data

US 2012/0177524 A1 Jul. 12, 2012

(30) Foreign Application Priority Data

Oct. 26, 2009 (JP) ..... 2009-245920
Mar. 10, 2010 (JP) ..... 2010-053633

(51) Int. Cl.

| | |
|---|---|
| ***F04B 1/04*** | (2006.01) |
| ***F01B 9/04*** | (2006.01) |
| ***F01B 1/06*** | (2006.01) |
| ***F04B 1/053*** | (2006.01) |
| ***F04B 9/04*** | (2006.01) |
| ***F04B 27/053*** | (2006.01) |
| ***F04B 35/01*** | (2006.01) |

(52) U.S. Cl.
CPC ..... *F01B 1/062* (2013.01); *F04B 1/053* (2013.01); *F04B 9/045* (2013.01); *F04B 27/053* (2013.01); *F04B 35/01* (2013.01)
USPC ..... 417/273; 92/140

(58) Field of Classification Search
CPC ..... F01B 1/062; F04B 27/053; F04B 1/053; F04B 9/045
USPC ..... 417/273; 92/140
See application file for complete search history.

(56) References Cited

U.S. PATENT DOCUMENTS 679,876 A * 8/1901 Blake ..... 123/47 R
5,811,676 A * 9/1998 Spalding et al. ..... 73/247

FOREIGN PATENT DOCUMENTS

| | | |
|---|---|---|
| JP | 56-141079 A | 11/1981 |
| JP | 59-165875 A | 9/1984 |
| JP | 63-61793 A | 3/1988 |
| JP | 5-90002 U | 12/1993 |

(Continued)

*Primary Examiner* — Charles Freay
(74) *Attorney, Agent, or Firm* — Birch, Stewart, Kolasch & Birch, LLP

(57) ABSTRACT

In the rotary type cylinder device, a first crank shaft is revolved around a shaft and a composite piston assembly is revolved around the first crank shaft in a state where first rotational mass balance relating to first and second piston units around second virtual crank shafts, second rotational mass balance relating to the composite piston assembly around the first crank shaft and third rotational mass balance relating to the first crank shaft and the composite piston assembly around the shaft are uniformly produced by only first and second balance weights which are attached to end parts of the first crank shaft. Therefore, first and second piston units, which are attached to the second cylindrical sections, are linearly reciprocally moved in radial directions of a circular orbit of second virtual crank shafts, which has radius of 2 r, with relatively revolving around the shaft.

3 Claims, 20 Drawing Sheets

(56) References Cited

FOREIGN PATENT DOCUMENTS

| | | | |
|---|---|---|---|
| JP | 6-60779 | U | 8/1994 |
| JP | 6-346867 | A | 12/1994 |
| JP | 11-236886 | A | 8/1999 |
| JP | 2000-510936 | A | 8/2000 |
| JP | 2004-190613 | A | 7/2004 |
| JP | 2008-101508 | A | 5/2006 |
| WO | WO-97/45657 | A1 | 12/1997 |

* cited by examiner

R1
R2
O
R
r
5
14a
14b
23
24
30

ROTARY CYLINDER DEVICE

BACKGROUND OF THE INVENTION

The present invention relates to a rotary type cylinder device capable of dealing with interconversion of reciprocating motions of pistons in cylinders and a rotary motion of a shaft, more precisely relates to a rotary type cylinder device which can be applied to internal-combustion engines, compressors, vacuum pumps, hydraulic rotary machines, etc.

In each of internal-combustion engines, compressors, vacuum pumps, hydraulic rotary machines, etc., various types of driving mechanisms are employed. For example, a reciprocal type driving mechanism in which a fluid is repeatedly sucked and discharged by reciprocating motions of piston units connected to a crank shaft, a scroll type driving mechanism in which a fluid is repeatedly sucked and discharged by revolving a movable scroll with respect to a fixed scroll, a rotary type driving mechanism in which a fluid is repeatedly sucked and discharged by rotary motion of a roller (see Japanese Laid-open Patent Publication No. P2004-190613A), a screw type driving mechanism, and a vane type driving mechanism are employed according to usage.

Especially, the reciprocal type driving mechanism is mainly used for internal-combustion engines, compressors, vacuum pumps, etc., each of which is rotated at a medium speed, e.g., 10000 rpm, and in each of which high airtightness is required.

In the reciprocal type driving mechanism, energy converting efficiency is easily lowered by energy loss caused by reciprocating motion of piston units in cylinders. Further, a connection rod for supporting the piston units reciprocally moved in the cylinders, a crank shaft being connected to the connecting rod and a crank arm being connected to the crank shaft are required, so an energy converting device, which converts the reciprocating motion of the piston units into a rotary motion, must be large in size. Vibration, which is caused by deviations of mass balances (gravity centers) of rotatable members while the piston units are reciprocally moved, must be absorbed by a damper, etc.

SUMMARY OF THE INVENTION

Accordingly, it is an object in one aspect of the invention to provide a rotary type cylinder device, in which rotatable members which are capable of revolving around a shaft at fixed rotational speeds can be compactly assembled in the axial and radial directions, piston units can be linearly reciprocally moved by combination of rotary motions around a plurality of crank shafts, and imbalance of masses of the rotatable members, which is caused by deviations of gravity centers caused by the linear and reciprocal motions of the piston units, can be repaired so as to restrain rotational vibration and reduce noise.

To produce the object, the rotary type cylinder device, which is capable of dealing with interconversion of reciprocating motions of pistons in cylinders and a rotary motion of an input/output shaft, comprises:

a first crank shaft 5 being eccentrically provided with respect to an axis of the input/output shaft 4, the first crank shaft 5 being revolved around the shaft by a first balance weight 9 adapted to function as a first virtual crank arm and having a radius of r from the input/output shaft 4;

a composite piston assembly P having an eccentric cylindrical body 6, which is constituted by a first cylindrical section 6*a*, to which the first crank shaft 5 is coaxially fitted, and second cylindrical sections 6*b*, whose axes are second virtual crank shafts 14*a*, 14*b* made eccentric with respect to an axis of the first cylindrical section 6*a* and which are integrated with the first cylindrical section 6*a* and located on each side of the first cylindrical section 6*a* in an axial direction, the composite piston assembly P being revolved relatively, around the first crank shaft 5, by a second balance weight 10 adapted to function as a second virtual crank arm and having a radius the radius of r in a state where a first piston unit 7 fitted to the one of the second cylindrical sections 6*b* and a second piston unit 8 fitted to the other another of second cylindrical section sections 6*b* intersect each other;

the first balance weight 9 and the second balance weight 10 are adapted to produce rotational balances of rotatable members which are provided around the input/output shaft 4 and can be rotated at fixed rotational speeds, the first balance weight 9 and the second balance weight 10 being respectively provided to both end parts of the first clank shaft 5, to which a composite of the first and second piston units 7, 8 is attached; and a main body case 3 rotatably holding the input/output shaft 4 which is integrally formed in a least one of the first balance weight 9 and the second balance weight 10, the main body case 3 rotatably accommodating the first crank shaft 5, the first balance weight 9 and the second balance weight 10, which are adapted to revolve relatively around the input/output shaft 4, and the composite piston unit, which is revolved adapted to revolve around the first crank shaft 5, and wherein the first crank shaft 5 is adapted to revolve around the input/output shaft 4 and the composite piston assembly P is adapted to revolve relatively around the first crank shaft 5 in a state where a first rotational mass balance B1 relating to the first and second piston units 7, 8, around the second virtual crank shafts 14*a*, 14*b*, a second rotational mass balance B2 relating to the composite piston assembly P around the first crank shaft 5 and a third rotational mass balance B3 relating to the first crank shaft 5 and the composite piston assembly P around the input/output shaft 4 are uniformly produced by only the first and second balance weights 9, 10 which are attached to the both end parts of the first crank shaft 5, thereby the first and second piston units 7, 8, which are attached to the second cylindrical sections 6*b*, are adapted to be linearly reciprocally moved in radial directions of a circular orbit of the second virtual crank shafts 14*a*, 14*b*, which has radius of 2*r*, while relatively revolving around the input/output shaft 4.

Note that, the first virtual crank arm means a part connecting the shaft to the axis of the first crank shaft. Even if there is no dedicated crank arm, a structure which can act as a crank arm is regarded as the first virtual crank arm. The second virtual crank arm means a part connecting the axis of the first crank shaft to the second virtual crank shafts. Even if there is no crank arm, a structure which can act as a crank arm is regarded as the second virtual crank arm. The second virtual crank shafts are virtual axes of revolution. Even if there are no physical axes of revolution, the virtual axes which can act as axes of revolution are regarded as the second virtual crank shafts. Further, each of the piston units means a unit in which a seal cap, a seal cap retainer, a piston ring, etc. are integrally attached to a piston head section.

Preferably, in the rotary type cylinder device, pinholes are formed in both end parts of the first crank shaft respectively, axes of the pinholes are perpendicular to the axis of the first crank shaft, axial holes and pinholes are formed in shaft sections of the first and second balance weights respectively, axes of the pinholes of the first and second balance weights are perpendicular to the axes of the first and second balance weights, and the both end parts of the first crank shaft are respectively fitted in the axial holes of the first and second balance weights in a state where the pinholes of the first crank shaft correspond to the pinholes of the first and second balance weights so as to integrate the first crank shaft with the first and second balance weights.

Preferably, in the rotary type cylinder device, at least one of the first and second balance weights is integrated with the shaft.

Preferably, in the rotary type cylinder device, each of the second cylindrical sections has bearing retainer parts, which are respectively formed in an inner circumferential face and an outer circumferential face, an inner bearing is retained by the bearing retainer parts formed in the inner circumferential face, an outer bearing is retained by the bearing retainer parts formed in the outer circumferential face, and the first crank shaft is rotatably held by the inner bearings, the first and second piston units are held by the outer bearings.

In the rotary type cylinder device of the present invention, the first crank shaft is revolved around the shaft by rotating the shaft, and the first and second piston units attached to the second cylindrical sections are linearly reciprocally moved along the radial directions of the circular orbit of the second virtual crank shafts, which has radius of 2 r, by revolving the composite piston assembly around the first crank shaft.

While the operation, the first rotational mass balance relating to the first and second piston units around the second virtual crank shafts, the second rotational mass balance relating to the composite piston assembly around the first crank shaft and the third rotational mass balance relating to the first crank shaft and the composite piston assembly around the shaft are uniformly produced by only the first and second balance weights. Further, imbalance, which is caused by deviations of gravity centers caused by the linear and reciprocal motions of the piston units, can be repaired, so that rotational vibration of the rotary type cylinder device can be restrained and operation noise can be reduced.

In the rotary type cylinder device of the invention, energy loss can be reduced and energy converting efficiency can be improved by restraining the rotational vibration caused by revolving the rotatable members around the shaft. Further, a vibration-proof mechanism can be simplified.

In comparison with conventional devices, number of crank shafts and crank arms can be reduced, so that the structure of the rotary type cylinder device of the invention can be simplified.

In case that the both end parts of the first crank shaft are respectively fitted in the axial holes of the first and second balance weights in the state where the pinholes of the first crank shaft correspond to the pinholes of the first and second balance weights, pins can be fitted and fixed in the pinholes, accuracy of attaching the first and second weights, in the directions perpendicular to their axes, to the both end parts of the first crank shaft can be improved.

In case that at least one of the first and second balance weights is integrated with the shaft, number of parts can be reduced. The first crank shaft can be compactly attached, in the axial and radial directions, to the shaft by adjusting a length of the first virtual crank arm, which connects the shaft to the first crank shaft. The length of the first virtual crank arm is adjusted by adjusting the revolving radius of the first and second balance weights.

In case that each of the second cylindrical sections has bearing retainer parts, which are respectively formed in the inner circumferential face and the outer circumferential face, the inner bearing is retained by the bearing retainer parts formed in the inner circumferential face, the outer bearing is retained by the bearing retainer parts formed in the outer circumferential face, and the first crank shaft is rotatably held by the inner bearings, the first and second piston units are held by the outer bearings, the composite piston assembly including the eccentric cylindrical body can be compactly attached, in the axial and radial directions, to the first crank shaft by adjusting a length of the second virtual crank arm, which connects the first crank shaft to the second virtual crank shafts. The length of the second virtual crank arm is adjusted by adjusting the revolving radius of the second cylindrical sections.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings. A rotary type cylinder device, which will be assembled in a compressor, will be explained as an embodiment of the present invention with reference to FIGS. 1-23B. The rotary type cylinder device is capable of dealing with interconversion of reciprocating motions of pistons in cylinders and a rotary motion of a shaft.

Figure 1:
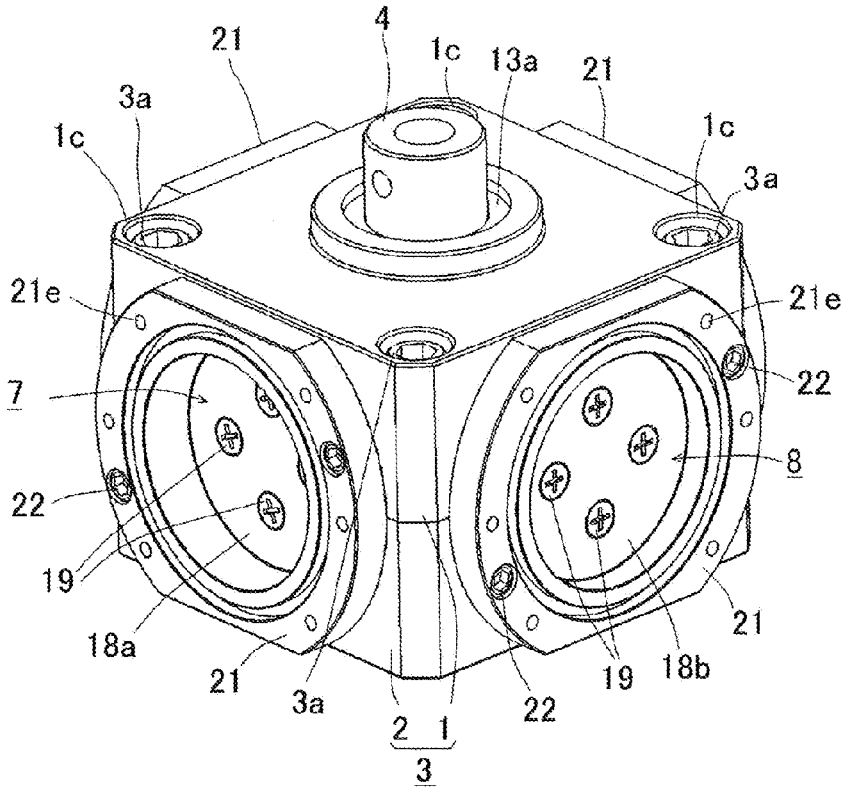
FIG. 1 is a perspective view of the rotary type cylinder device of the present invention.

In FIG. 1, a shaft (input/output shaft) 4 is rotatably held in a main body case 3, which is constituted by a first case 1 and a second case 2. The first case 1 and the second case 2 are integrated by bolts 3*a*, which are respectively provided to four corners of the main body case 3. In the main body case 3, as shown in FIG. 3, an eccentric cylindrical body 6, which can be revolved around a first crank shaft 5, and a first piston unit 7 and a second piston unit 8, which constitute a composite piston assembly P (see FIG. 2) and which can be revolved around the first crank shaft 5, are rotatably accommodated in the main body case 3. Details of the structural members will explained.

Figure 7:
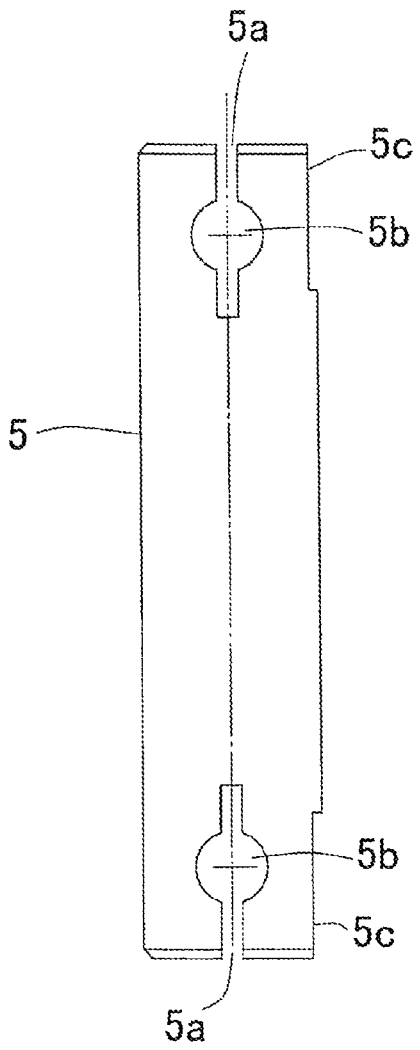
FIG. 7 is a front view of the first crank shaft.
Figure 8B:
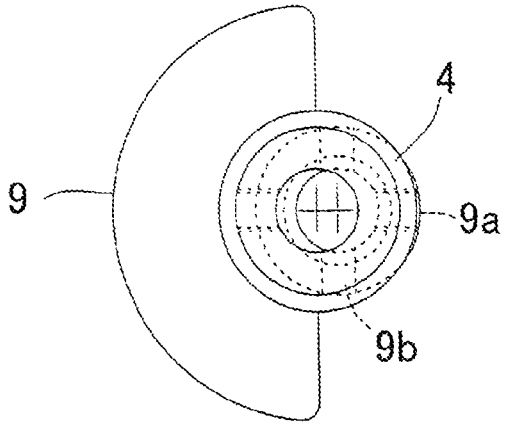
FIG. 8B is a plan view of the first balance weight.
Figure 8A:
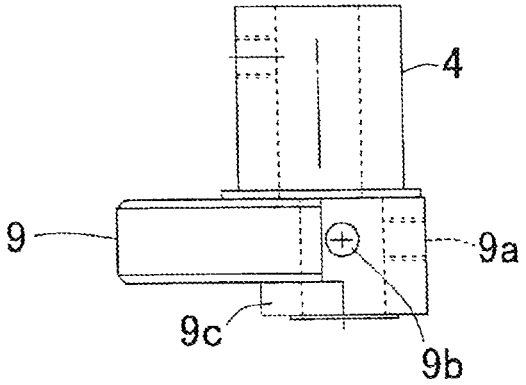
FIG. 8A is a front view of a first balance weight.
Figure 8C:
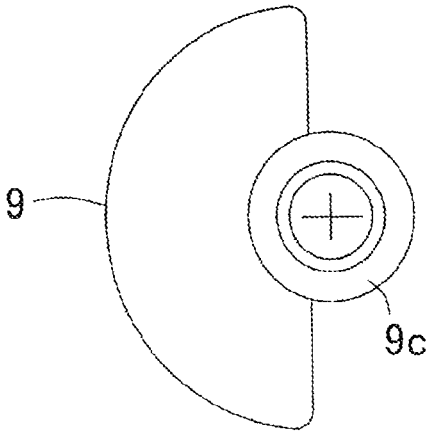
FIG. 8C is a bottom view of the first balance weight.
Figure 9B:
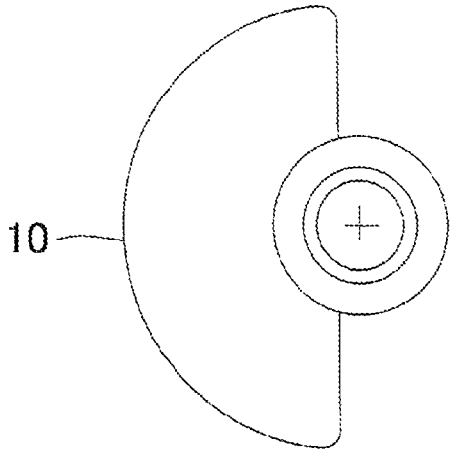
FIG. 9B is a plan view of the second balance weight.
Figure 9A:
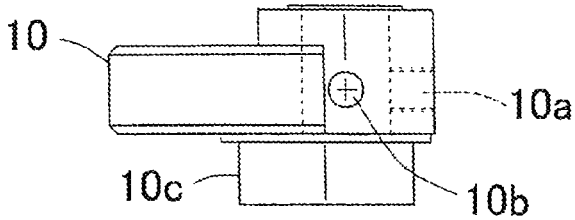
FIG. 9A is a front view of a second balance weight.
Figure 9C:
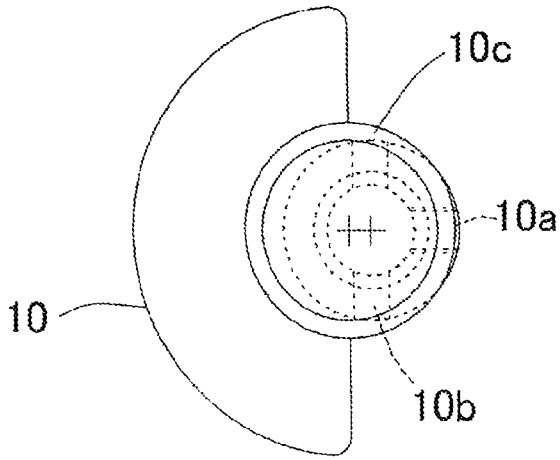
FIG. 9C is a bottom view of the second balance weight.

In FIG. 3, the first crank shaft 5 is eccentrically attached to the shaft 4. In the present embodiment, the shaft 4 is integrated with a first balance weight 9. Note that, a shaft may be integrated with a second balance weight 10. The first and second balance weights 9 and 10 are respectively fitted with end parts of the first crank shaft 5. In FIG. 7, slits 5*a* are respectively formed in the both end parts of the first crank shaft 5 and extended in the axial direction thereof. A pinhole 5*b*, whose axial line is perpendicular to that of the first crank shaft 5, is formed in each of the slits 5*a*. A diameter of the pinhole 5*b* is larger than a width of the slit 5*a*, and the pinhole 5*b* overlaps a part of the slit 5*a*. D-shaped parts 5*c*, whose end faces are formed into D-shape, are respectively formed in the both end parts of the first crank shaft 5. The first and second balance weights 9 and 10 are respectively fitted with the both end parts of the first crank shaft 5 in a state where the pinholes 5*a* correspond to pinholes 9*b* and 10*b* of the first and second balance weights 9 and 10 (see FIGS. 8A and 9A).

In FIGS. 8A-8C and 9A-9C, a bolt hole 9*a* and the pinhole 9*b* are formed in a shaft section of the first balance weight 9; a bolt hole 10*a* and the pinhole 10*b* are formed in a shaft section of the second balance weight 10. The first and second balance weights 9 and 10 are fitted with the first crank shaft 5 in a state where the pinholes 5*b* of the first crank shaft 5 (see FIG. 7) correspond to the pinholes 9*b* and 10*b*. A pin 11*a* (see FIG. 3) is fitted in the pinholes 5*b* and 9*b*, which are mutually communicated; a pin 11*b* (see FIG. 3) is fitted in the pinholes 5*b* and 10*b*, which are mutually communicated. Bolts 12*a* and 12*b* are respectively fitted in the bolt holes 9*a* and 10*a* so as to narrow the slits 5*a* and the pinholes 5*b*. Therefore, the pins 11*a* and 11*b* are retained, and the first and second balance weights 9 and 10 can be integrated with the both end parts of the first crank shaft 5 (see FIG. 4). With this structure, accuracy of attaching the first and second balance weights 9 and 10 to the both end parts of the first crank shaft 5, in the direction perpendicular to the axial line of the first crank shaft 5, can be improved.

In FIG. 3, the shaft 4, which is integrated with the first balance weight 9, is rotatably supported by a first bearing 13*a*; a shaft section 10*c*, which is formed coaxially with the shaft 4 of the second balance weight 10, is rotatably supported by a second bearing 13*b*. For example, the first and second balance weights 9 and 10 are fan-shaped blocks (see FIGS. 8B, 8C, 9B and 9C). The first and second balance weights 9 and 10 are used for producing rotational balance between rotatable members attached around the shaft 4, e.g., the first crank shaft 5, the composite piston assembly P.

As described above, the shaft 4 is integrated with at least one of the first and second balance weights 9 and 10, so that number of parts can be reduced. Further, the first crank shaft 5 can be compactly attached to the shaft 4, in the axial direction and the radial direction, by adjusting a length of a first virtual crank arm, which connects the shaft 4 to the first crank shaft 5. The length of the first virtual crank arm is adjusted by adjusting, for example, revolving radius r of the first and second balance weights 9 and 10.

Figure 10A:
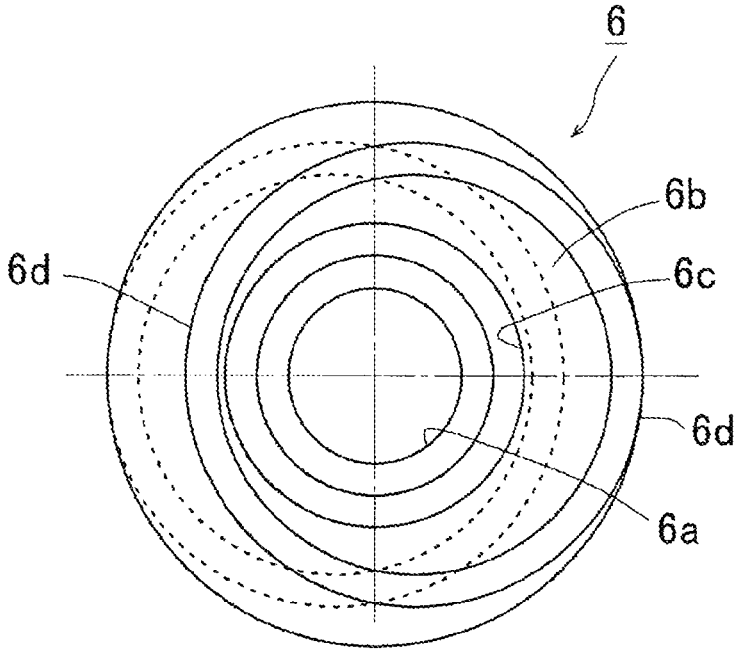
FIG. 10A is a plan view of an eccentric cylindrical body.
Figure 10B:
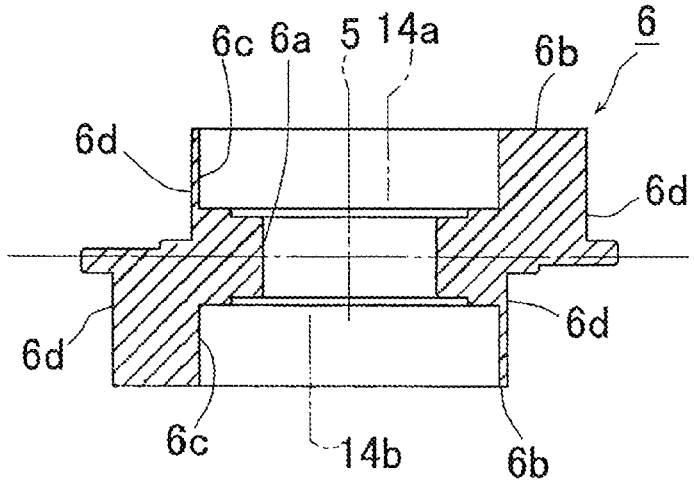
FIG. 10B is a sectional view of the eccentric cylindrical body taken along the X-axis.

As shown in FIG. 10B, the eccentric cylindrical body 6 has a plurality of second virtual crank shafts 14*a* and 14*b*, which are eccentrically disposed with respect to the axis of the first crank shaft 5. In the present embodiment, the two piston units 7 and 8 are crisscrossed, so the second virtual crank shafts 14*a* and 14*b* are disposed around the first crank shaft 5 with a phase difference of 180 degrees.

As shown in FIG. 3, the crisscrossed piston units 7 and 8 is attached to the eccentric cylindrical body 6, which is capable of revolving around the first crank shaft 5. As shown in FIG. 10B, the eccentric cylindrical body 6 is constituted by a first cylindrical section 6*a*, through which the first crank shaft 5 acting as a rotary shaft is pierced, and second cylindrical sections 6*b*, which are extended from both axial ends of the first cylindrical section 6*a*. The first crank shaft 5 is coaxially fitted in the first cylindrical section 6*a* and acts as a rotary shaft of the eccentric cylindrical body 6. Axial lines of the second cylindrical sections 6*b* correspond to the second virtual crank shafts 14*a* and 14*b*, which are eccentrically disposed with respect to the axial line of the first crank shaft 5 (the first cylindrical section 6*a*). As shown in FIG. 3, the first and second piston units 7 and 8, which are crisscrossed each other, are rotatably attached to the second cylindrical sections 6*b* by outer bearings 16*a* and 16*b*.

In FIGS. 10A and 10B, each of the second cylindrical sections 6*b* has a bearing retainer part 6*c*, which is formed in an inner circumferential face, and a bearing retainer part 6*d*, which is formed in an outer circumferential face. As shown in FIG. 3, inner bearings 15*a* and 15*b* are respectively retained by the bearing retainer parts 6*c*; the outer bearings 16*a* and 16*b* are respectively retained by the bearing retainer parts 6*d*. The inner bearings 15*a* and 15*b* rotatably support the first crank shaft 5. As shown in FIG. 3, the first and second piston units 7 and 8 are rotatably supported by the outer bearings 16*a* and 16*b* in a state where the first and second piston units 7 and 8 are fitted to the second cylindrical sections 6*b* and their axial lines are perpendicular to the second virtual crank shafts 14*a* and 14*b*.

With this structure, the composite piston assembly P including the eccentric cylindrical body 6 can be compactly attached to the first crank shaft 5, in the axial direction and the radial direction, by adjusting a length of a second virtual crank arm, which connects the first crank shaft 5 to the second virtual crank shafts 14*a* and 14*b*. The length of a second virtual crank arm is adjusted by adjusting revolving radius of the second cylindrical sections 6*b*.

The first and second piston units 7 and 8 are fitted to the second cylindrical sections 6*b* of the eccentric cylindrical body 6, their axial lines are perpendicular to the second virtual crank shaft 14*a* and 14*b*, and first piston head sections 7*c* and second piston head sections 8*c* are reciprocally moved in the same plane. Therefore, the composite piston assembly P (see FIG. 2) can be compactly assembled, so that the device can be downsized and its installation space can be made smaller.

Figure 2:
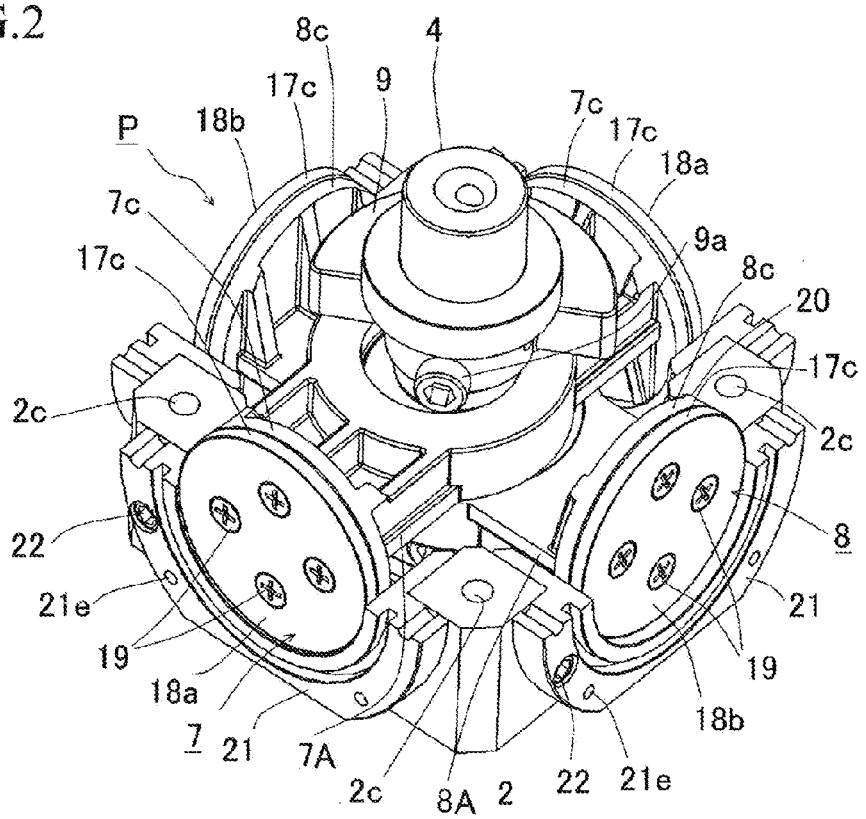
FIG. 2 is a perspective view of the rotary type cylinder device shown in FIG. 1, wherein a first case is detached.
Figure 3:
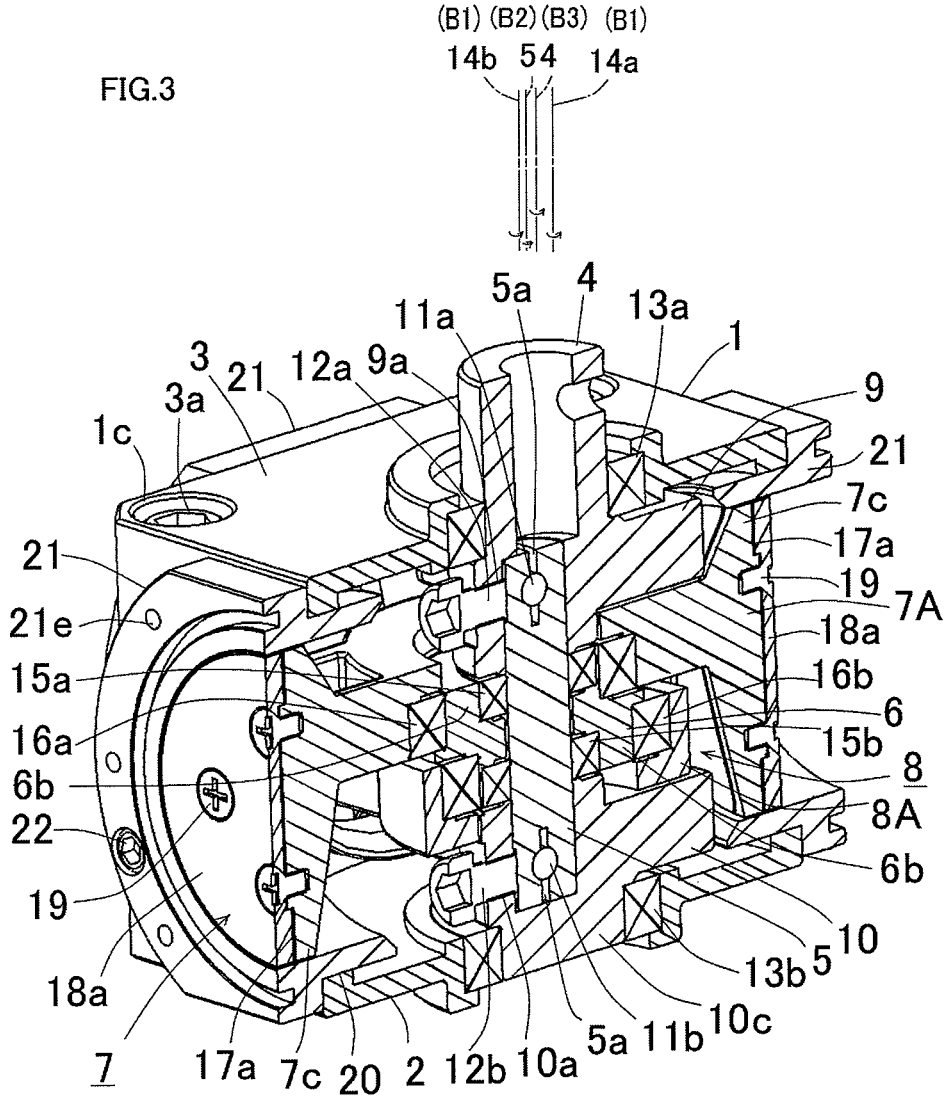
FIG. 3 is a sectional perspective view of the rotary type cylinder device shown in FIG. 1.

In FIG. 2, the first piston head sections 7*c* are provided to both axial ends of a first piston main body 7A; the second piston heads 8*c* are provided to both axial ends of a second piston main body 8A. Ring-shaped seal caps 17*a* and 17*b* (see FIGS. 16A and 16B) and seal cap retainers 18*a* and 18*b* (see FIGS. 17A and 17B) are fixed to the first and second piston head sections 7*c* and 8*c* by bolts 19. The seal caps 17*a* and 17*b* are composed of an oil-free sealing material, e.g., polyether ether ketone (PEEK). Erecting sections 17*c* are formed along outer circumferential edges and extended in the moving directions of the piston heads (see FIGS. 16A and 16B). In a compressor, a hydraulic rotary machine, etc., the erecting sections 17*c* are extended in the moving directions of the first and second piston head sections 7*c* and 8*c* and headed outside (see FIG. 23A).

In FIGS. 2 and 3, cylinders 21 are fitted in opening parts 20, which are formed in four side faces of the main body case 3 constituted by the first and second cases 1 and 2, by bolts 22. In FIG. 2, the first and second piston units 7 and 8 slide on inner faces 21*f* of the cylinders 21 (see FIG. 15B) with sealing clearances therebetween by the seal caps 17*a* and 17*b* (the erecting sections 17*c*). Note that, the seal caps 17*a* and 17*b* are very light and their revolving masses can be ignored, so function of balancing first to third rotational balances to be described later, which is performed by the first and second balance weights 9 and 10, is not influenced.

Figure 13A:
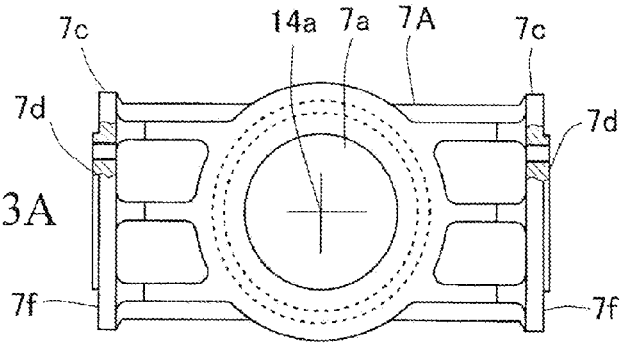
FIG. 13A is a partially cutaway plan view of a first piston main body.
Figure 13B:
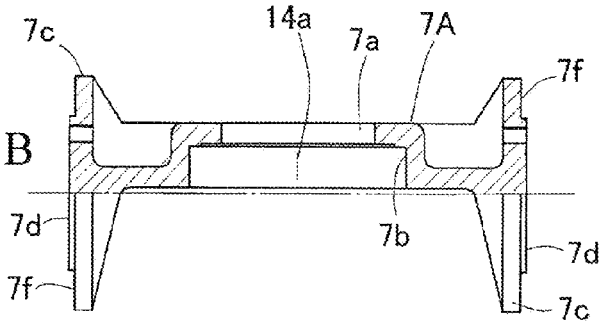
FIG. 13B is a sectional view of the first piston main body taken along the Z-axis.
Figure 13C:
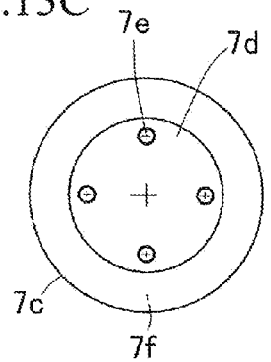
FIG. 13C is a right side view of the first piston main body.
Figure 13D:
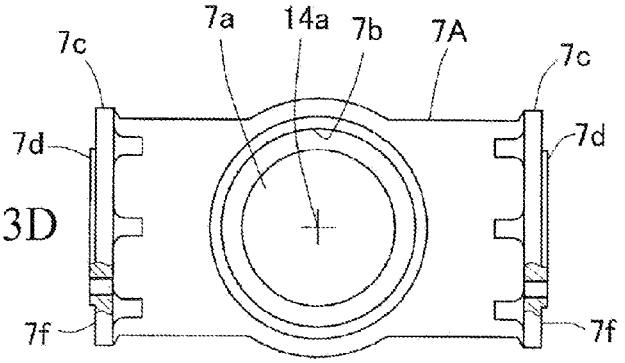
FIG. 13D is a bottom view of the first piston main body.

FIG. 13A is a partially cutaway plan view of the first piston main body 7A, wherein the seal caps and the seal cap retainers are detached; FIG. 13B is a sectional view thereof taken along the Z-axis; FIG. 13C is a right side view thereof; and FIG. 13D is a bottom view thereof. The first and second piston main bodies 7A and 8A have the same configuration, so only the first piston main body 7A will be explained. Note that, structural elements of the second piston main body 8A (see FIG. 2) are the same as those of the first piston main body 7A. An escape hole 7*a* (see FIG. 13A), which is formed for preventing interference with a main part 9*c* of the shaft 4 (see FIG. 8A), is formed in the center of the first piston main body 7A. The center of the escape hole 7*a* corresponds to the second virtual crank shaft 14*a*. A bearing retainer part 7*b*, which retains the outer bearing 16*a*, is formed to enclose the escape hole 7*a* (see FIGS. 13B and 13D).

Figure 4:
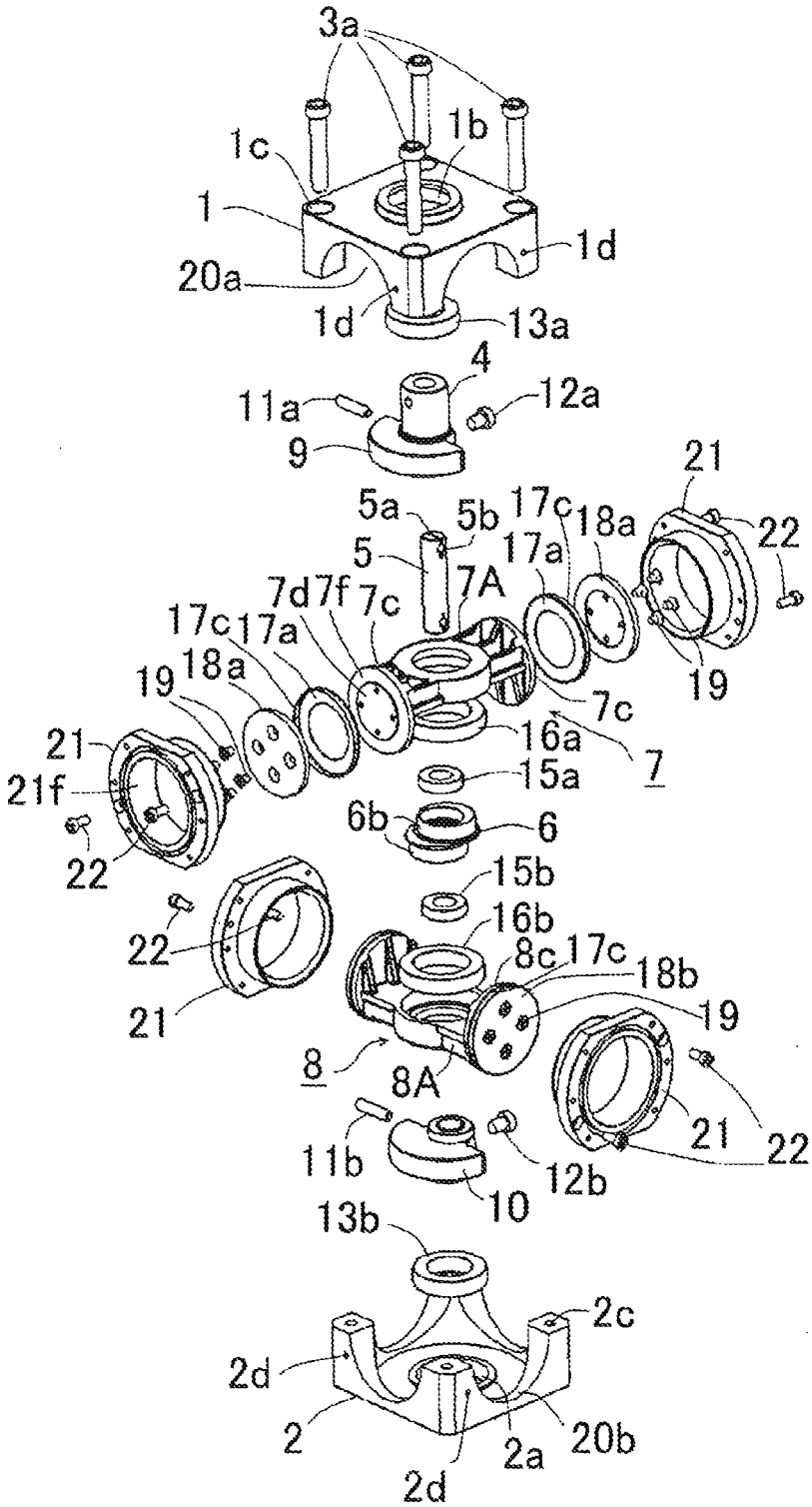
FIG. 4 is an exploded perspective view of the rotary type cylinder device.

The first piston head sections 7*c*, each of which is formed into a circular plate, are respectively provided to the axial both ends of the first piston main body 7A. Base plates 7*d*, which have bolt holes 7*e*, are provided to the first piston main body 7A (see FIG. 13C). As shown in FIG. 13A, the base plates 7*d* are respectively provided to the both end faces of the first piston main body 7A, the seal caps 17*a* shown in FIG. 4 are fitted to stepped parts 7*f*, each of which is formed on the radially outer side of the base plate 7*d*, and then the seal cap retainers 18*a* are stacked on the seal caps 17*a* in a state where bolt holes 18*c* correspond to bolt holes 7*e* (see FIG. 13C). By screwing the bolts 19 in the bolt holes 18*c* and 7*e*, the seal caps 17*a* are clamped and integrated between the seal cap retainers 18*a* and the first piston head 17*c*. Further, the seal caps 17*b* are clamped and integrated between the seal cap retainers 18*b* and the second piston head 18*c* as well.

Figure 14A:
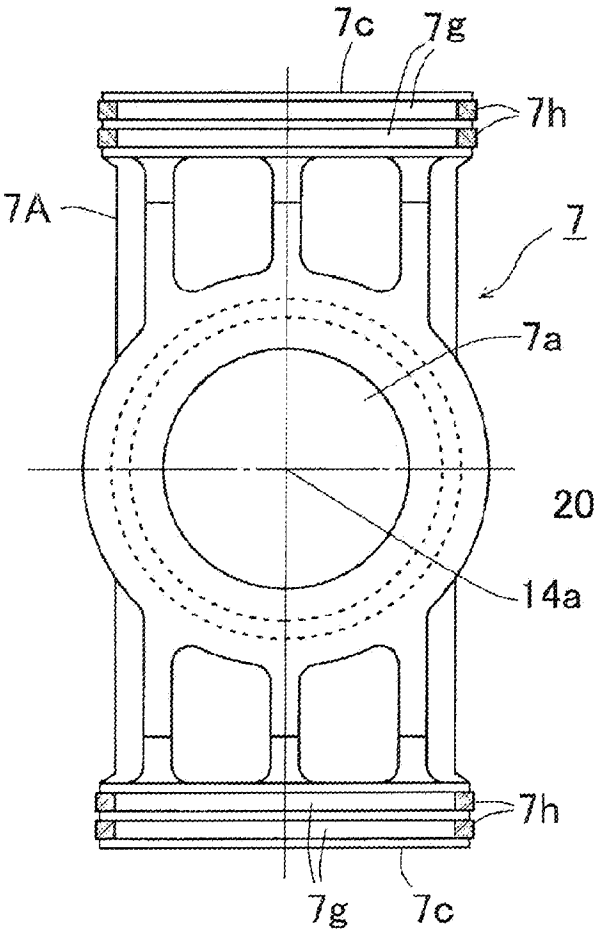
FIG. 14A is a front view of the piston unit, to which a piston ring of an internal-combustion engine is attached.
Figure 14B:
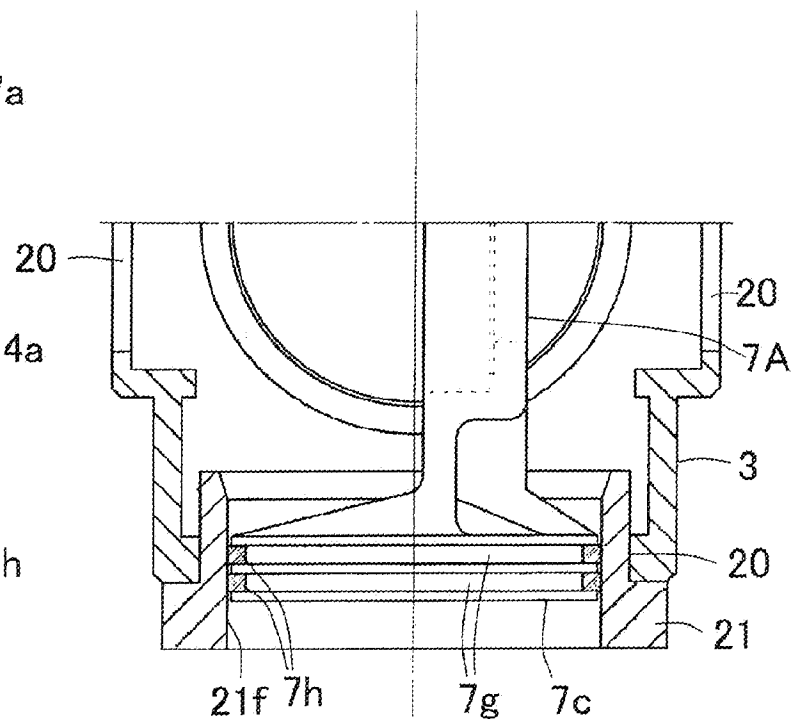
FIG. 14B is a partial sectional view of the piston unit, which is accommodated in a main body case.

An example of the structure of the first piston unit 7 is shown in FIGS. 14A and 14B. A plurality of circular grooves 7*g* are formed in an outer circumferential face of each of the first piston head sections 7*c*. A piston ring (sealing member) 7*h* is fitted in each of the circular grooves 7*g*. The first piston unit 7 is attached to the opening part 20 of the main body case 3. The sealing members 7*h* slide on the inner faces 21*f* of the cylinders 21. By fitting cylinder heads (not shown) to the cylinders 21, airtightness of cylinder chambers can be highly maintained.

Figure 18:
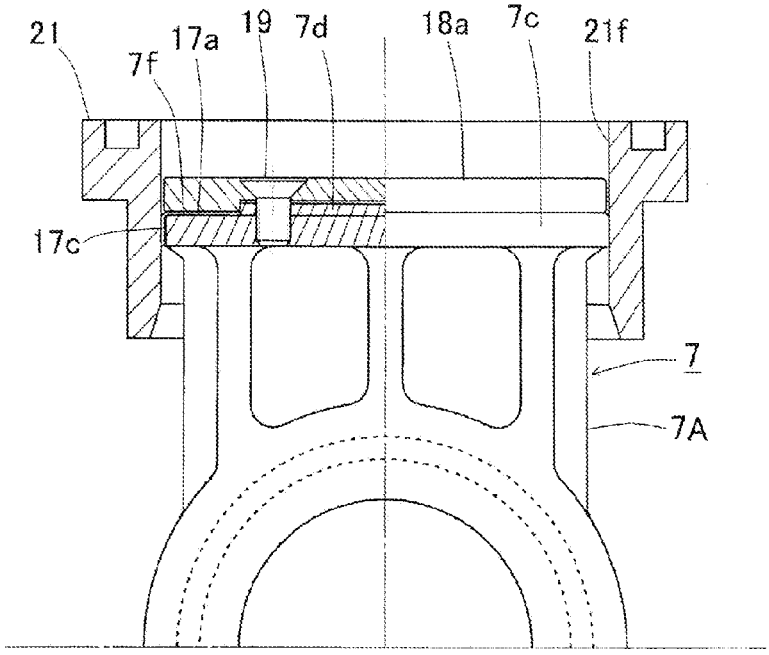
FIG. 18 is a partial sectional view of a cylinder seal cap assembly of a vacuum pump.

FIG. 18 shows an example of the first piston unit 7 which is attached in a vacuum pump for air suction. The erecting section 17*c* of the seal cap 17*a* is headed inside and fitted to the stepped part 7*f* formed on the end face of the first piston head section 7*c*. The seal cap retainer 18*a* is stacked on the seal cap 17*a* and the bolt 19 is screwed, so that the seal cap 17*a* is clamped and integrated between the seal cap retainer 18*a* and the first piston head 7*s* (see FIG. 4).

Figure 15A:
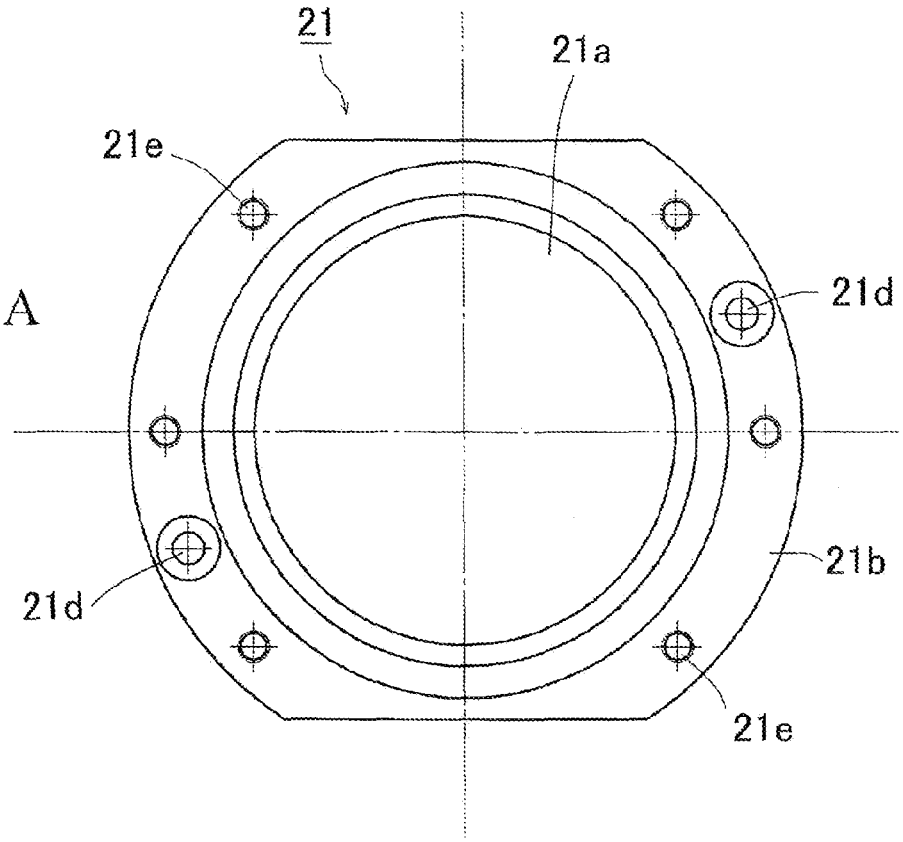
FIG. 15A is a plan view of a cylinder.
Figure 15B:
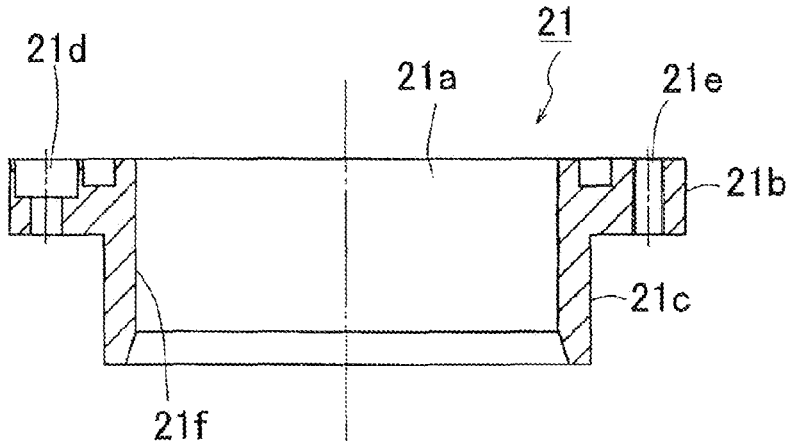
FIG. 15B is a sectional view of the cylinder taken along the X-axis.
Figure 16A:
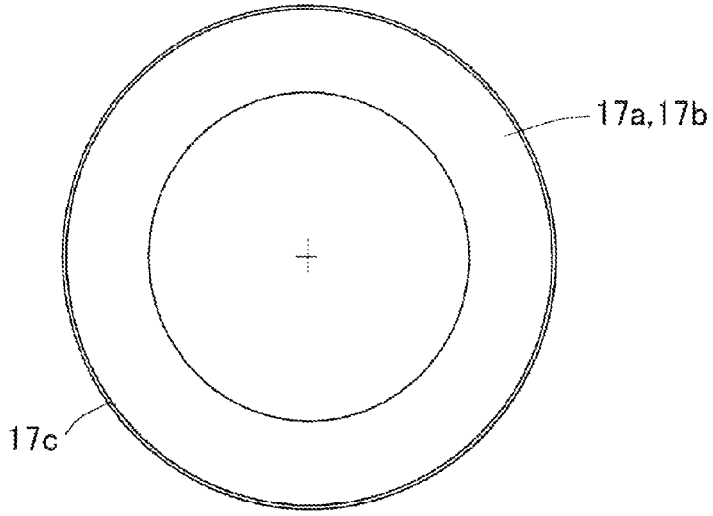
FIG. 16A is a plan view of a cylinder seal cap.
Figure 16B:
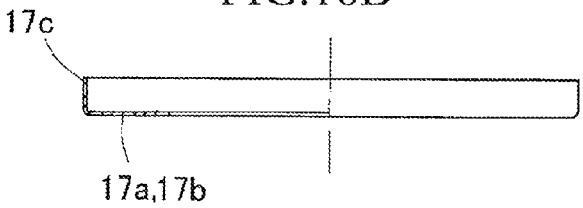
FIG. 16B is a sectional view of the cylinder seal cap taken along the X-axis.
Figure 17B:
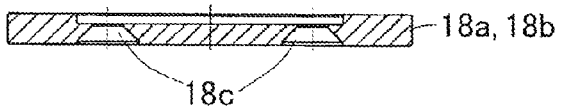
FIG. 17B is a sectional view of the seal retainer taken along the X-axis.
Figure 17A:
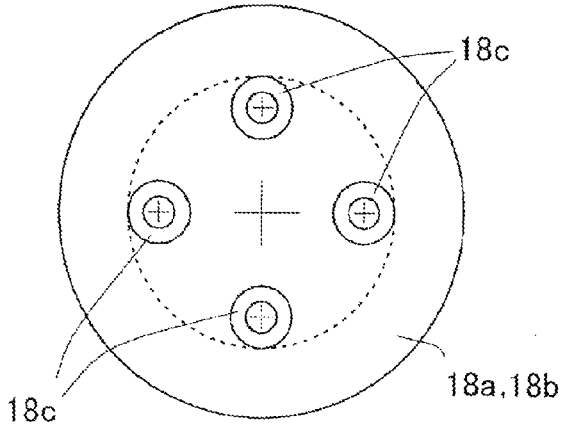
FIG. 17A is a plan view of a seal retainer.

As shown in FIGS. 15A and 15B, the cylinder 21 has a flange 21*e*, which is formed along an edge of an opening part 21*a*, and a cylindrical body part 21*c* is extended from the flange 21*e*. The first piston head sections 7*c* of the first piston unit 7 and the second piston heads 8*c* of the second piston unit 8 slide on the inner faces 21*f* of the cylindrical body parts 21*c* and the flanges 21*b* (see FIGS. 1 and 2).

Two through-holes 21*d* are formed in the flange 21*b*. The cylindrical body part 21*c* is inserted into the opening part 20 of the main body case 3 (see FIG. 3), and the flange 21*b* is brought into contact with the side face of the main body case 3. At that time, the through-holes 21*d* correspond to bolt holes 1*d* of the first case 1 and bold holes 2*d* of the second case 2. Therefore, the cylinders 21 are fixed to the main body case 3 by screwing bolts 22 into the through-holes 21*e* and the bolt holes 1*d* and 2*d* (see FIG. 4).

In FIGS. 15A and 15B, a plurality of bolt holes 21*e* are formed in the flange 21*b*. The bolt holes 21*e* are used when the cylinder head is stacked on and fixed to the cylinder 21 by bolts.

Figure 11B:
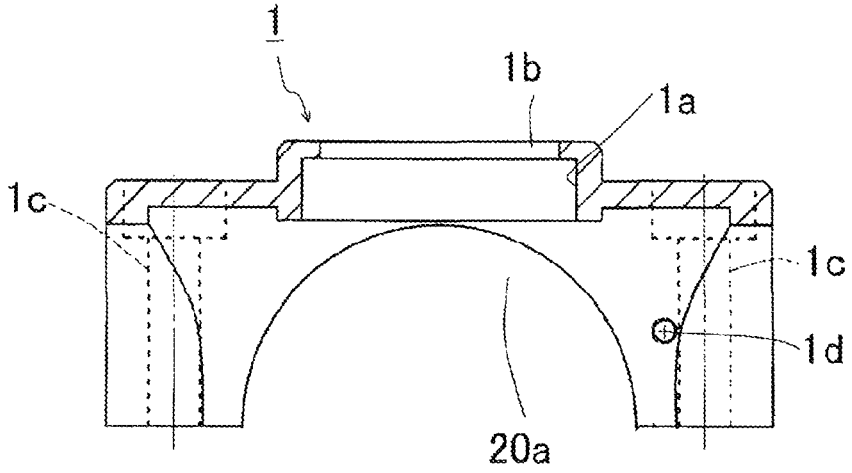
FIG. 11B is a sectional view of the first case taken along the X-axis.
Figure 11A:
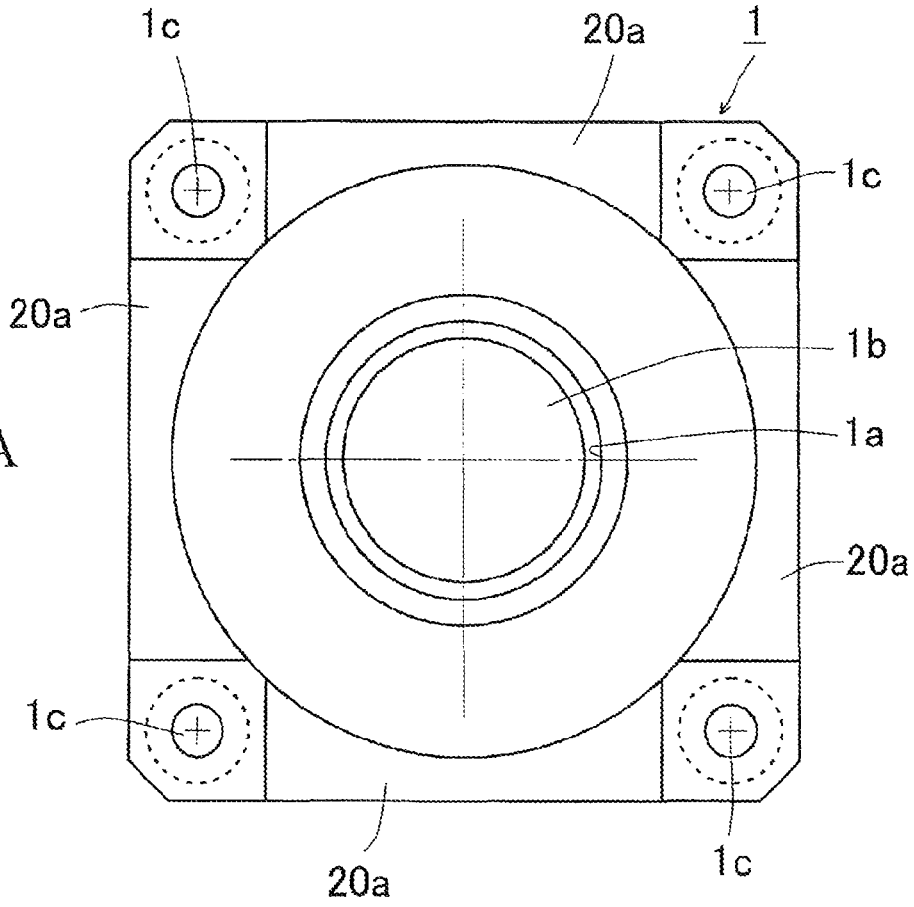
FIG. 11A is a plan view of the first case.

In FIGS. 11A and 11B, an opening part 20*a* is formed in each of four side faces of the first case 1. A bearing retainer part 1*a* is formed at an axial end of the first case 1. A first bearing 13*a* is fitted to the bearing retainer part 1*a* (see FIG. 3). An opening part 1*b* is formed in the center of the bearing retainer part 1*a*. The shaft 4, which is integrated with the first balance weight 9, is pierced through the first bearing 13*a*, which is retained by the bearing retainer part 1*a*, and outwardly projected from the main body case 3 via the opening part 1*b* (see FIG. 3). Bolt holes 1*c* are respectively formed at four corners of the first case 1, and bolts 3*a* (see FIG. 1) will be screwed into the bolt holes 1*c*. Further, bolt holes 1*d* are formed in the four side faces of the first case 1, and bolts 22 (see FIG. 1) will be screwed into the hold holes 1*d*.

Figure 12A:
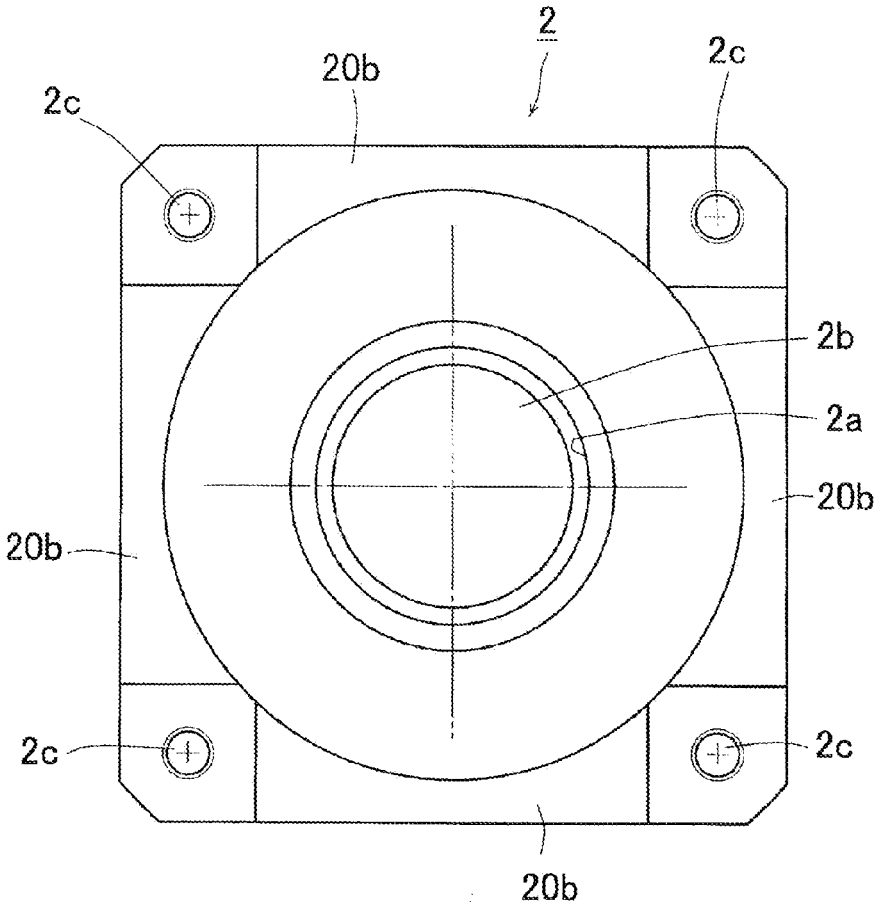
FIG. 12A is a plan view of a second case.
Figure 12B:
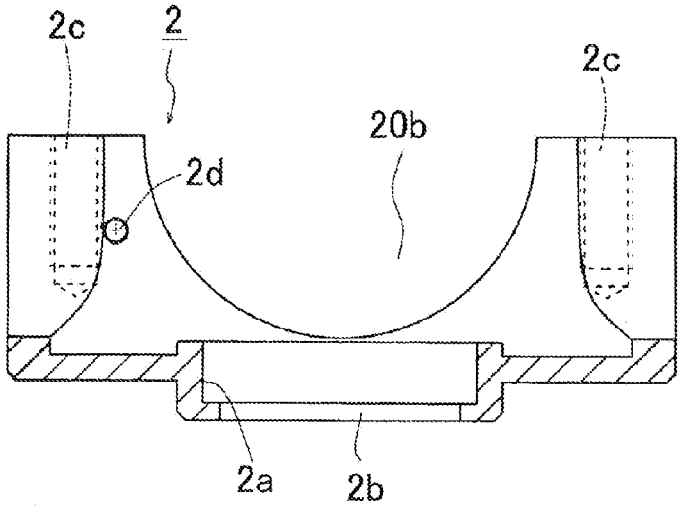
FIG. 12B is a sectional view of the second case taken along the X-axis.

In FIGS. 12A and 12B, an opening part 20*b* is formed in each of four side faces of the second case 2. A bearing retainer part 2*a* is formed at an axial end of the second case 2. A second bearing 13*b* is fitted to the bearing retainer part 2*a* (see FIG. 3). An opening part 2*b* is formed in the center of the bearing retainer part 2*a*. The shaft section 10*c*, which is integrated with the second balance weight 10, is pierced through the second bearing 13*b*, which is retained by the bearing retainer part 2*a* (see FIG. 3). Bolt holes 2*c* are respectively formed at four corners of the second case 2, and the bolts 3*a* (see FIG. 1) will be screwed into the bolt holes 2*c* in a state where the bolt holes 2*c* correspond to the bolt holes 1*c* of the first case 1. Further, bolt holes 2*d* are formed in the four side faces of the second case 2, and the bolts 22 (see FIG. 1) will be screwed into the hold holes 2*d*.

Next, the assembly structure of the rotary type cylinder device will be explained with reference to FIG. 4.

The inner bearings 15*a* and 15*b* are attached to the bearing retainer parts 6*c*. The first crank shaft 5 is fitted in the center hole of the first cylindrical section 6*a*, to which the inner bearings 15*a* and 15*b* have been attached (see FIG. 3). The first and second piston units 7 and 8 are fitted, in the second cylindrical sections 6*b* respectively, with the outer bearings 16*a* and 16*b*, to form crisscross arrangement.

The first and second balance weights 9 and 10 are respectively fitted to the both ends of the first crank shaft 5. The pins 11*a* and 11*b* are fitted in the pinholes 5*b* and the bolts 12*a* and 12*b* are screwed so as to integrate the first and second balance weights 9 and 10 to the first crank shaft 5. The first bearing 13*a* is fitted in the bearing retainer part 1*a* of the first case 1, and the second bearing 13*b* is fitted in the bearing retainer part 2*a* of the second case 2. The shaft 4 is fitted in the first bearing 13*a*, the shaft section 10*c* of the second balance weight 10 is fitted in the second bearing 13*b*, and the first and second cases 1 and 2 are combined to form the main body case 3. Therefore, the first crank shaft 5, the first and second balance weights 9 and 10 and the composite piston assembly P (see FIG. 2) are accommodated in the main body case 3 (see FIG. 1). The bolt holes 1*c* are corresponded to the bolt holes 2*c*, and then the bolts 3*a* are screwed thereinto, so that the main body case 3 (see FIG. 1) can be completely assembled. Finally, the cylinders 21 are fitted into the opening parts 20 (see FIGS. 2 and 3) respectively formed in the four side faces of the main body case 3, and then the first and second cylinder head parts 7*c* and 8*c* are slidably fitted into the opening parts 21*a* of the cylinders 21 respectively (see FIG. 2), so that the rotary type cylinder device can be completed.

In the above described rotary type cylinder device, first rotational balance of the first and second piston units 7 and 8 around the second virtual crank shafts 14*a* and 14*b*, second rotational balance of the composite piston assembly P around the first crank shaft 5 and third rotational balance of the first crank shaft 5 and the composite piston assembly P around the shaft 4 are uniformly produced by only the first and second balance weights 9 and 10.

With this structure, even if the first and second piston units 7 and 8, which are attached to the second cylindrical sections 6*b*, are linearly reciprocally moved in the radial directions of a circle 23 (see FIG. 5A) around the shaft 4 (i.e., a circular orbit of the second virtual crank shafts 14*a* and 14*b*) by revolving the first crank shaft 5 around the shaft 4 and revolving the composite piston assembly P around the first crank shaft 5. Deviations of the center of gravities of the first and second piston units 7 and 8, which are caused by the linear reciprocating motions thereof, are repaired by producing balances, so that noise can be reduced. By reducing rotational vibration, mechanical loss caused by the linear reciprocating motions of the piston heads can be prevented, so that energy converting efficiency of the first and second piston units 7 and 8 can be greater than that of the conventional reciprocal type driving mechanism. Further, a vibration-proof mechanism, e.g., damper, can be simplified.

The rotary motions of the first crank shaft 5 and the second virtual crank shafts 14*a* and 14*b* around the shaft 4 and the linear reciprocating motions of the first and second piston units 7 and 8 will be explained with reference to FIGS. 5A-5L. In FIGS. 5A-5L, the center O of the circle 23 corresponds to the axis of the shaft 4. The first crank shaft 5 is shifted from the center O. The second virtual crank shafts 14*a* and 14*b* are revolved, without slip, by revolving the first crank shaft 5. Number of the second virtual crank shafts 14*a* and 14*b* is equal to that of the piston units 7 and 8.

A distance r between the center O (the shaft 4) and the axis of the first crank shaft 5 is an arm length (revolving radius) of the first virtual crank arm and the second virtual crank arm. The first crank shaft 5 is revolved around the shaft 4 (the center O) along a circular orbit 30 whose radius is equal to the arm length r of the first virtual crank arm. The second virtual crank shafts 14*a* and 14*b* are apparently revolved around the first crank shaft 5 along a circular orbit (virtual circle) 24 whose radius is equal to the arm length r of the second virtual crank arm. Therefore, the first and second piston units 7 and 8 can be reciprocally moved in the radial directions of the circle 23 whose center is the center O and whose radius R is equal to the diameter 2*r* of the virtual circle 24.

Figures 5A, 5B, 5C, 5D, 5E, 5F, 5G, 5H, 5I, 5J, 5K, 5L:
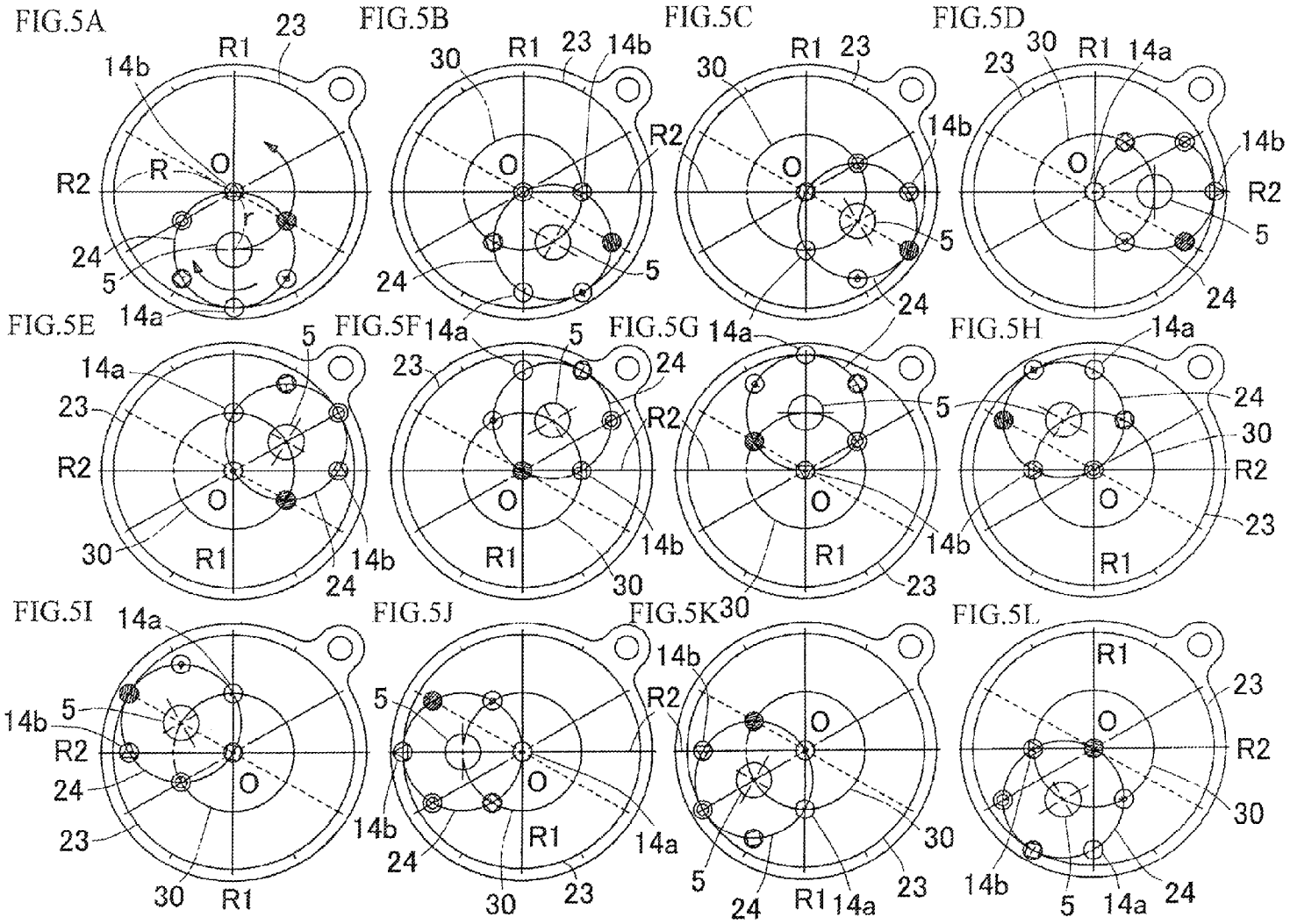
FIGS. 5A-5L are explanation views showing rotary motions of a first crank shaft and second virtual crank shafts and linear reciprocal motions of crank arms.

In the present embodiment, the axes of the second cylindrical sections 6*b*, to which the first and second piston units 7 and 8 are fitted in the crisscross form, are the second virtual crank shafts 14*a* and 14*b*. In FIG. 5A, the second virtual crank shafts 14*a* and 14*b* are disposed on the virtual circle 24, having the radius of r, around the first crank shaft 5 with a phase difference of 180 degrees. The second virtual crank shaft 14*a* is located at an intersection point (the lowermost point) of the circle 23 and the diameter R1; the second virtual crank shaft 14*b* is located at the center O of the circle 23 (the axis of the shaft 4). The first crank shaft 5 is separated the distance r from the center O of the circle 23.

In case of revolving the first crank shaft 5 around the center O of the circle 23 in the counterclockwise direction will be explained. Note that, the virtual circle 24 revolves, without slip, along the circle 23 in the clockwise direction. In each of FIGS. 5A-5L, the first crank shaft 5 is shifted by 30 degrees.

When the first crank shaft 5 is revolved 90 degrees, in the counterclockwise direction, from the position shown in FIG. 5A, the first crank shaft 5 is moved to the position shown in FIG. 5D. While this operation, the second virtual crank shaft 14*a* is moved, along the diameter R1 of the circle 23, to the center O, and the second virtual crank shaft 14*b* is moved to an intersection point (the rightmost point) of the diameter R2, which perpendicularly crosses the diameter R1, and the circle 23.

When the first crank shaft 5 is further revolved 90 degrees, in the counterclockwise direction, from the position shown in FIG. 5D, the first crank shaft 5 is moved to the position shown in FIG. 5G. While this operation, the second virtual crank shaft 14*a* is moved to an intersection point (the uppermost point) of the circle 23 and the diameter R1, and the second virtual crank shaft 14*b* is moved to the center O of the circle 23.

When the first crank shaft 5 is further revolved 90 degrees, in the counterclockwise direction, from the position shown in FIG. 5G, the first crank shaft 5 is moved to the position shown in FIG. 5J. While this operation, the second virtual crank shaft 14*a* is moved to the center O of the circle 23, and the second virtual crank shaft 14*b* is moved to an intersection point (the leftmost point) of the circle 23 and the diameter R2.

When the first crank shaft 5 is further revolved 90 degrees, in the counterclockwise direction, from the position shown in FIG. 5J, the first crank shaft 5 is moved to the position shown in FIG. 5A. While this operation, the second virtual crank shaft 14*a* is moved to an intersection point (the lowermost point) of the circle 23 and the diameter R1, and the second virtual crank shaft 14*b* is moved to the center O of the circle 23.

By revolving the first crank shaft 5 around the center O (the shaft 4), the second virtual crank shaft 14*a* is reciprocally moved along the diameter R1 of the circle 23, which is the circular orbit of the virtual circle 24, and the second virtual crank shaft 14*b* is reciprocally moved along the diameter R2 of the circle 23.

With the rotary motion of the first crank shaft 5 along the circular orbit 30, which has the radius r from the shaft 4 (the center O), and the rotary motions of the second virtual crank shafts 14*a* and 14*b* along the circular orbit, which has the radius r from the first crank shaft 5, the first piston unit 7, which is fitted to the second cylindrical section 6*b* whose axis corresponds to the second virtual crank shaft 14*a*, is repeatedly reciprocally moved along the diameter R1 of the circle 23, whose radius is 2 r and whose center corresponds to the axis of the shaft 4; the second piston unit 8, which is fitted to the second cylindrical section 6*b* whose axis corresponds to the second virtual crank shaft 14*b*, is repeatedly reciprocally moved along the diameter R2 of the circle 23, whose radius is 2 r and whose center corresponds to the axis of the shaft 4.

Figure 6A:
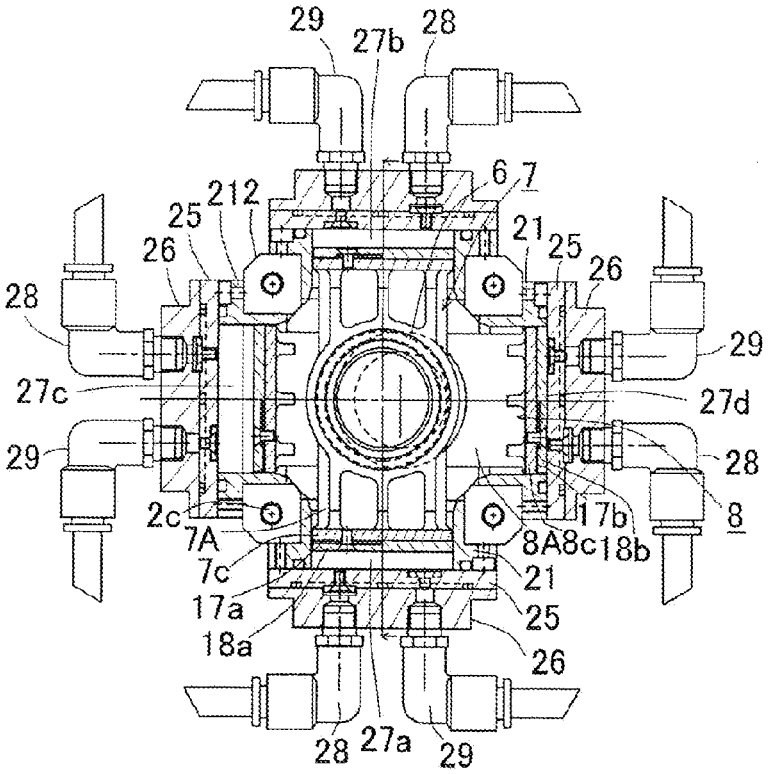
FIG. 6A is a plan view of a compressor to which the rotary type cylinder device is applied, wherein the first case is detached.
Figure 6B:
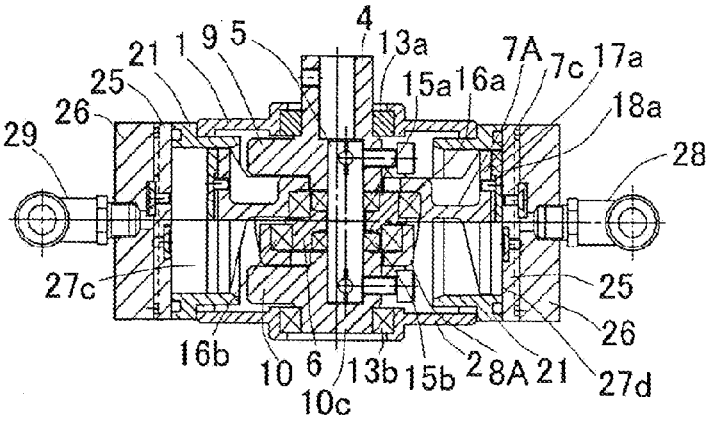
FIG. 6B is a sectional view of the compressor taken along the Z-axis.
Figure 6C:
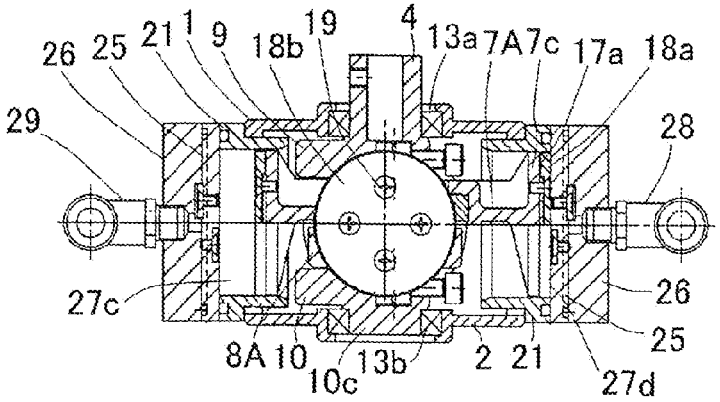
FIG. 6C is a sectional view of the compressor taken along the Z-axis, wherein piston units are crisscrossed.

As shown in FIGS. 6A-6C, for example, first and second cylinder heads 25 and 26 are respectively attached to the cylinders 21, in which the first and second piston head sections 7*c* and 8*c* are accommodated respectively, by using the bolt holes 21*e* (see FIGS. 15A and 15B) to respectively face the first and second piston head sections 7*c* and 8*c*, so that cylinder chambers 27*a*, 27*b*, 27*c* and 27*d* are formed. A fluid outlet 28 and a fluid inlet 29 are provided to each of the cylinder chambers 27*a*, 27*b*, 27*c* and 27*d*.

For example, by rotating the shaft 4 by a motor, etc., the first crank shaft 5 and the eccentric cylindrical body 6 are revolved. The eccentric cylindrical body 6 is revolved around the first crank shaft 5, so that the first and second piston units 7 and 8 are linearly reciprocally moved in the radial directions of the circle 23 (see FIG. 5A), which has the radius of r from the shaft 4. While this operation, a fluid is sucked into the cylinder chambers 27*a*, 27*b*, 27*c* and 27*d* via the fluid inlets 29 and discharged therefrom via the fluid outlets 28. Therefore, a compressor or a pump can be realized.

The rotary motion of the shaft 4 and the linear reciprocating motions of the first and second piston head sections 7*c* and 8*c* will be explained with reference to FIGS. 19-22.

Figure 19:
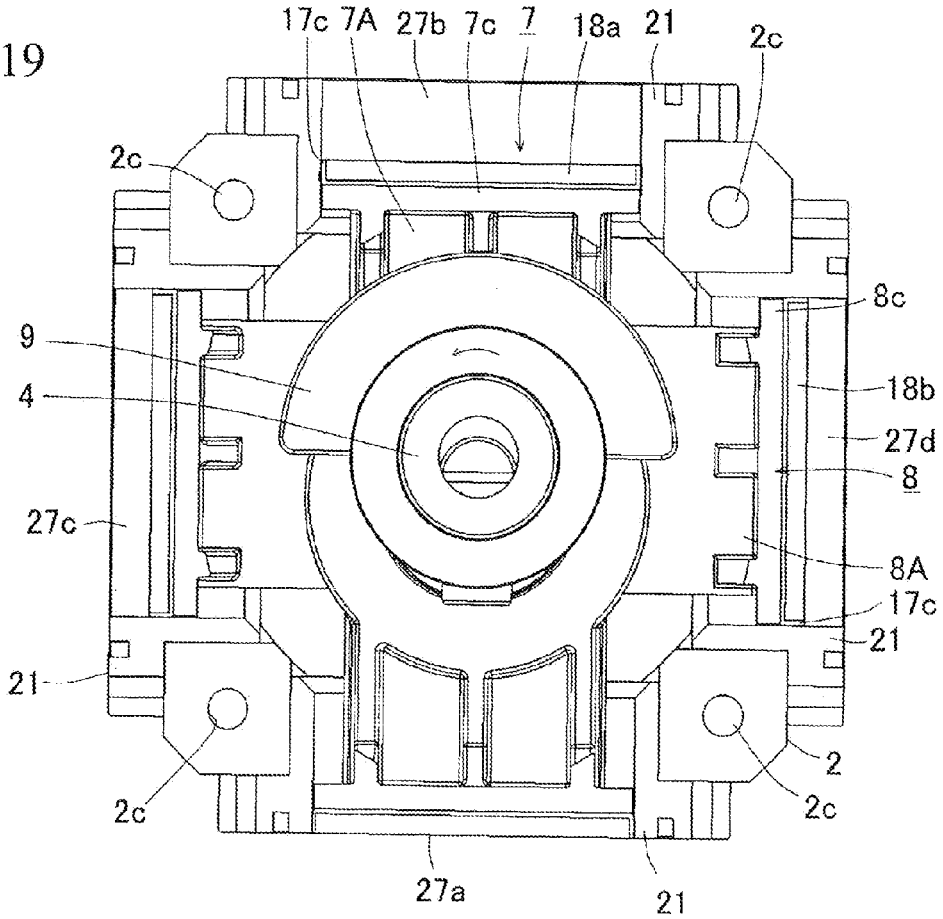
FIG. 19 is a plan explanation view showing the piston unit and a rotational position of the shaft, wherein the first case is detached.
Figure 20:
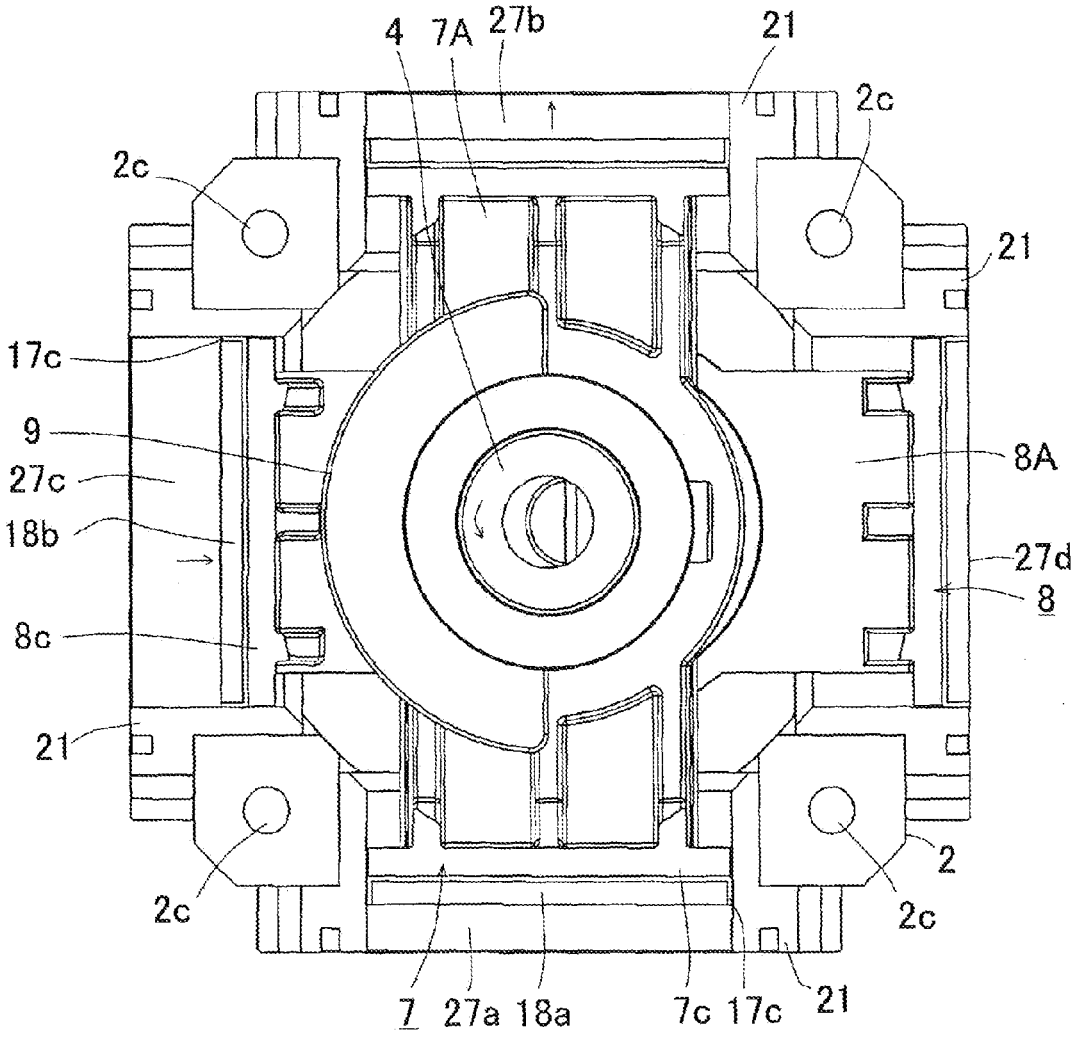
FIG. 20 is a plan explanation view showing the piston unit and a rotational position of the shaft, wherein the first case is detached.
Figure 21:
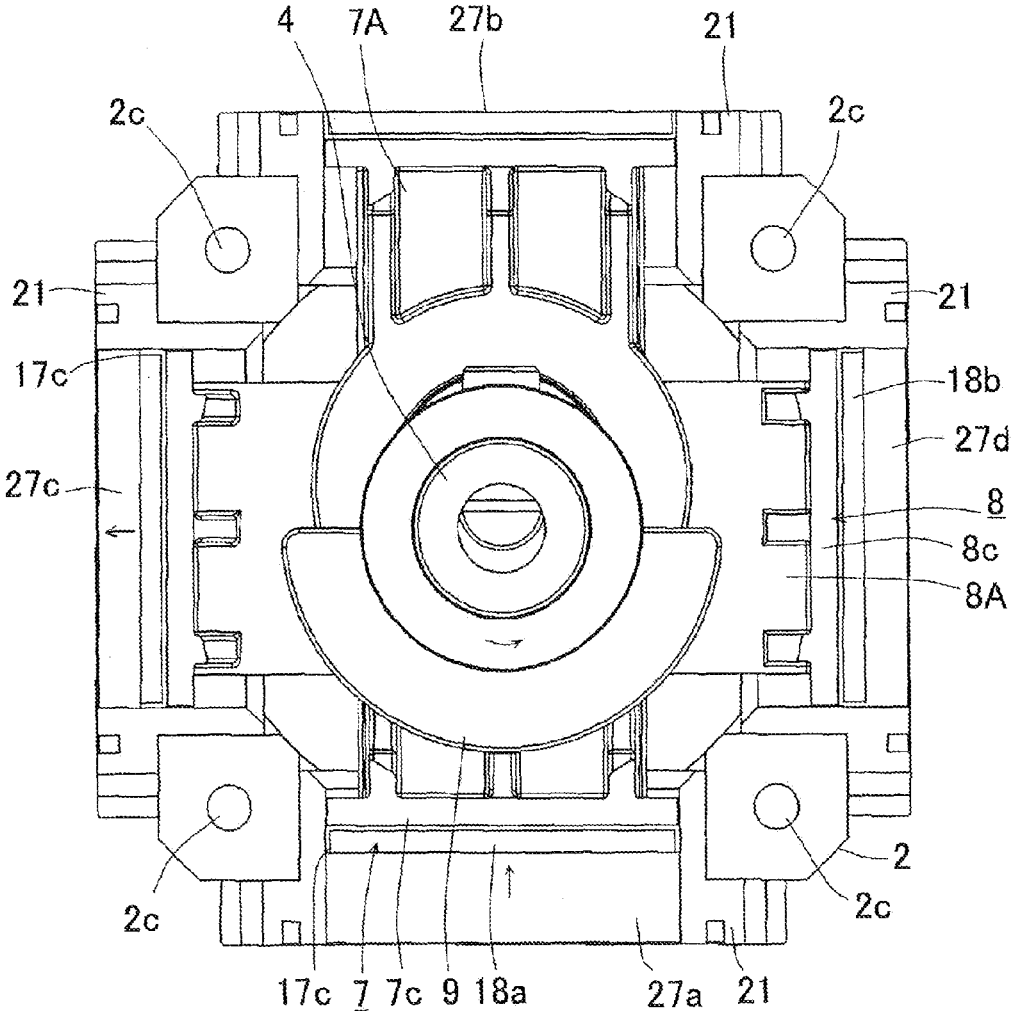
FIG. 21 is a plan explanation view showing the piston unit and a rotational position of the shaft, wherein the first case is detached.
Figure 22:
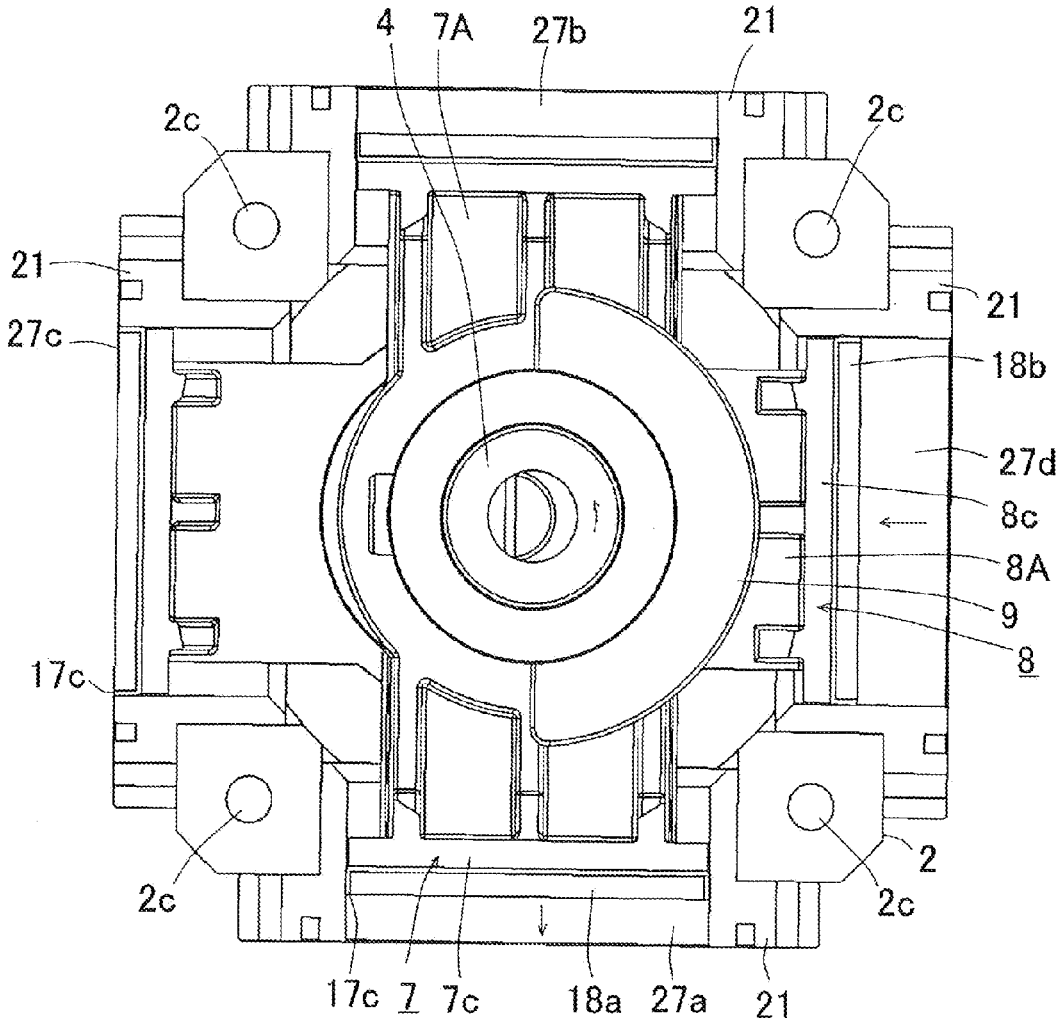
FIG. 22 is a plan explanation view showing the piston unit and a rotational position of the shaft, wherein the first case is detached.

In FIG. 19, the shaft 4 is located at the initial position; in FIG. 20, the shaft 4 is rotated 90 degrees from the initial position; in FIG. 21, the shaft 4 is rotated 180 degrees from the initial position; and in FIG. 22, the shaft 4 is rotated 270 degrees from the initial position. In FIGS. 19 and 20, the first piston unit 7 is moved upward, and the second piston unit 8 is moved rightward. The fluid is sucked into the cylinder chambers 27*a* and 27*c*; the fluid is discharged from the cylinder chambers 27*b* and 27*d*. In FIGS. 20 and 21, the first piston unit 7 is moved upward, and the second piston unit 8 is started to move leftward. The fluid is discharged from the cylinder chambers 27*b* and 27*c*; the fluid is sucked into the cylinder chambers 27*a* and 27*d*. In FIGS. 21 and 22, the first piston unit 7 is started to move downward, and the second piston unit 8 is moved leftward. The fluid is discharged from the cylinder chambers 27*a* and 27*c*; the fluid is sucked into the cylinder chambers 27*b* and 27*d*.

Note that, the first and second piston head sections 7*c* and 8*c* need not have the circular shapes, so they may have polygonal shapes. In case of using a part of the piston units assembled in a compressor as a vacuum pump, the device can be used as a hybrid type pump.

In this case, the seal caps 17*a* and 17*b* are attached to the piston head section, which is used as the compressor, and their erecting sections 17*c* are outwardly extended in the sliding direction; the seal caps 17*a* and 17*b* are also attached to the piston head section, which is used as the vacuum pump, preferably their erecting sections 17*c* are inwardly extended in the sliding direction (see FIG. 18). In case that the fluid is water or a liquid, the seal caps 17*a* and 17*b* may be omitted.

In the above described embodiment, the rotary type cylinder device has two piston units. Number of the piston units may be three or more. In case of the device having three piston units, for example, three second virtual crank shafts are disposed, on the virtual circle 24 shown in FIG. 5A, around the first crank shaft 5 with angular separation of 120 degrees.

In one of the piston units, the piston head sections may be omitted. If the second virtual crank shaft corresponds to the axis of the shaft 4 in one piston unit, a rotational dead point will occur. However, by omitting the piston head sections in one of the piston units, the occurrence of the rotational dead point in the one piston unit can be avoided, so that the rotary motion of the rotary type cylinder device can be continued.

In the above described embodiment, the first and second piston head sections 7*c* and 8*c* are attached to the eccentric cylindrical body 6 so as to reciprocally move in the same X-Y plane. In case that the eccentric cylindrical body is divided into a plurality of parts, a plurality of the piston units can be arranged in the height direction (the Z-axis direction) and crisscrossed at different heights.

In the above described embodiment, the first and second piston units 7 and 8 are crisscrossed, but their arrangement is not limited. For example, the first and second piston units 7 and 8 may be disposed around the first crank shaft 5 with a phase difference of 60 degrees, etc.

As shown in FIGS. 14A and 14B, piston rings 7*h* are respectively provided to the first and second piston head sections 7*c* and 8*c*. This structure may be applied to internal-combustion engines.

For example, if air intake valves, air release valves, an injector, a spark plug, etc. are provided to each of the cylinder chambers, which are formed by attaching the cylinder heads to the cylinders 21, this structure can be applied to engines. In this case, the first and second piston units 7 and 8 are linearly reciprocally moved by explosive-burning fuel in the cylinder chambers, so that the linear reciprocal motions of the piston units can be converted into and outputted as the rotary motions of the eccentric cylindrical body 6 and the first crank shaft 5 (the composite piston assembly P) around the shaft 4.

Figure 23A:
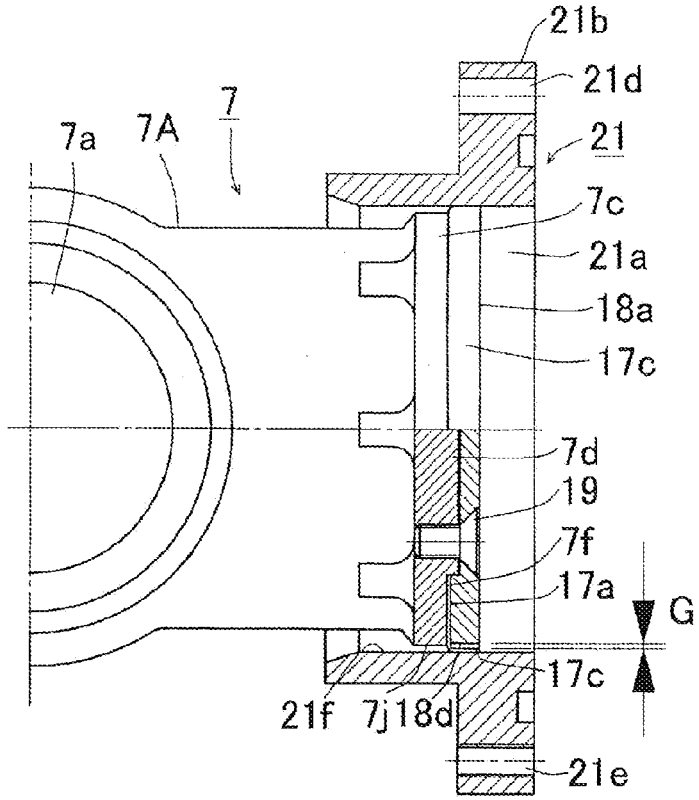
FIGS. 23A and 23B are partial sectional views of the piston unit and the cylinder.
Figure 23B:
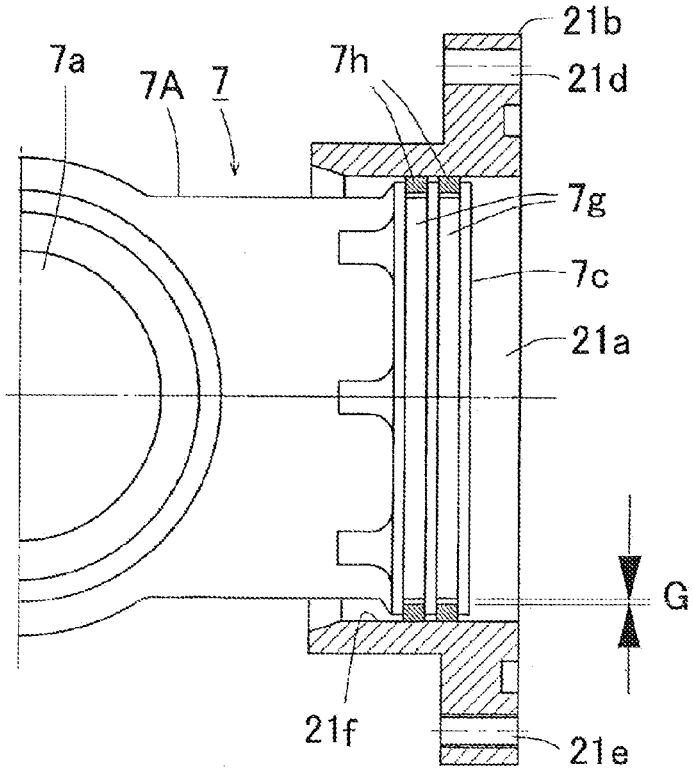

FIG. 23A is a partial sectional view of the cylinder 21 of the first piston unit 7 used for a compressor or a hydraulic rotary machine, and FIG. 23B is a partial sectional view of the cylinder 21 of the first piston unit 7 used for an internal-combustion engine. The second piston unit 8 has the same structure, so explanation will be omitted.

In FIG. 23A, a gap G between the inner face 21*f* of the cylinder 21 and outer circumferential faces 7*j* and 18*d* of the piston head section 7*c* and the seal cap retainer 18*a* is designed, with considering dimension change caused by machining error and temperature variation, so as to prevent mechanical interference. The gap G is minimized, so that the erecting section 17*c* of the seal cap 17*a* can slide, without biting the inner face 21 of the cylinder 21, and maintain sealing property.

In FIG. 23B, a gap G is formed between the circular groove 7*g* and the piston ring (sealing member) 7*h* so as to set the piston ring 7*h* in the circular groove 7*g* of the piston head section 7*c*. In case of balancing the third rotational balance of the first crank shaft 5 and the composite piston assembly P around the shaft 4, the motion of the piston ring 7*h*, in the radial direction, in the cylinder is limited, so the third rotational balance cannot be produced perfectly. Thus, a preferable error range of balancing design is 3% or less.

As shown in FIG. 6A, four cylinder heads are provided in a 2-piston/4-head rotary type cylinder device, so a part of the cylinder heads may be used for generating positive pressure and the rest cylinder heads may be used for generating negative pressure.

Further, multistage compression of air can be performed by four cylinder heads. In this case, strokes of the piston units cannot be changed, so diameters of a piston and a cylinder must be changed even in one piston unit. Preferably, the first to third rotational balances are produced by the first and second balance weights 9 and 10.

As described above, the first crank shaft is revolved around the shaft 4 and the eccentric cylindrical body 6 is revolved around the first crank shaft 5 by rotating the shaft 4, so that the first and second piston units 7 and 8, which are attached to the second cylindrical sections 6*b* whose axes correspond to the second virtual crank shaft 14*a* and 14*b*, are linearly reciprocally moved in the radial directions of the circle 23 (see FIG. 5A), which has the radius r from the shaft 4, along the circular orbit (hypocycloid) of the second virtual crank shafts 14*a* and 14*b*.

While the operation, the first rotational balance relating to the first and second piston units 7 and 8 around the second virtual crank shafts 14*a* and 14*b* (see FIG. 10B), the second rotational balance relating to the composite piston assembly P around the first crank shaft 5 and the third rotational balance relating to the first crank shaft 5 and the composite piston assembly P around the shaft 4 can be produced by the first and second balance weights 9 and 20. Further, deviations of gravity centers caused by the linear and reciprocal motions of the first and second piston units 7 and 8, can be repaired, so that a compact rotary type cylinder device, which is capable of reducing rotational vibration and noise, can be produced.

By reducing rotational vibration caused by rotation around the shaft 4, mechanical loss can be reduced and energy converting efficiency can be improved. Further, a vibration-proof mechanism, e.g., damper, can be simplified.

In comparison with conventional devices, number of elements constituting the crank shaft and the crank arms can be reduced, so that the simple crank mechanisms can be realized.

If the first rotational balance is lost, the second and third rotational balances are lost, too. Japanese Laid-open Patent Publication No. P63-24158A discloses a hypocycloid rotary type cylinder device capable of producing balances of rotatable members (see column 6, line 31-34). However, in the patent publication, only balances of a shaft and a crank shaft are produced. The technical idea of producing rotational balances of a slider connected to the crank shaft and rotatable members, including a piston assembly, connected to the slider is not disclosed, at all. Conventionally, there was no technical idea of repairing deviation of gravity center caused by linear and reciprocal motion of a piston unit, so vibration caused by the deviation of gravity center was absorbed by a vibration absorbing mechanism, e.g., damper.

On the other hand, in the rotary type cylinder device of the present invention, the rotatable members including the shaft 4, the first crank shaft 5 and the second virtual crank shafts 14*a* and 14*b* are capable of revolving at fixed revolving speeds with respect to the centers, the first to third rotational balances are produced by the first and second balance weights 9 and 10, so that a total balance is well maintained. Further, the deviations of gravity centers caused by the linear and reciprocal motions of the first and second piston units 7 and 8 can be repaired. Therefore, the hypocycloid rotary type cylinder device, which is capable of restraining rotational vibration caused by the rotary motions around the shaft 4 and the linear reciprocal motions of the first and second piston units 7 and 8, can be produced.

Balancing performance of a compressor of 46 cc displacement, which relates to the present invention, and a conventional similar mechanism will be explained. Note that, eccentric weight of the first crank shaft 5 around the shaft 4 is 10 g, and eccentric weight of the composite piston assembly P attached to the first crank shaft 5 is 210 g (including first and second piston units 7 and 8, the eccentric cylindrical body 6, the inner bearings 15*a* and 15*b* and the outer bearings 16*a* and 16*b*).

In the present invention, the first to third rotational balances are produced by the first and second balance weights 9 and 10, so that the rotary motion around the shaft 4 can be performed with balancing the eccentric weight of 220 g. Therefore, mechanical loss can be reduced, energy converting efficiency can be improved and noise can be reduced. On the other hand, in Japanese Laid-open Patent Publication No. P63-24158A, only a crank shaft revolved around a shaft is balanced. The balance of the crank shaft (10 g) around the shaft is poorly produced (about 5%). Therefore, rotational vibration must be great, mechanical loss must be great, and energy converting efficiency must be low. Further, the vibration must be absorbed by, for example, damper due to intense noise.

Since the shaft 4 is integrated with at least one of the first and second balance weights 9 and 10, number of parts can be reduced. Further, the first crank shaft 5 can be compactly attached around the shaft 4, in the axial direction and the radial direction, by adjusting the length of the first virtual crank arm, which connects the shaft 4 to the first crank shaft 5. The length of the first virtual crank arm is adjusted by adjusting the revolving radius of the first and second balance weights 9 and 10.

The inner and outer bearings 15*a*, 15*b*, 16*a* and 16*b* are respectively retained by the bearing retainer parts 6*c* and 6*d*, which are formed in the inner circumferential faces of the second cylindrical sections 6*b*. The first crank shaft 5 is rotatably held by the inner bearings 15*a* and 15*b*, and the first and second piston units 7 and 8 are rotatably held by the outer bearings 16*a* and 16*b*. Therefore, the composite piston assembly P including the eccentric cylindrical body 6 can be compactly attached, in the axial and radial directions, around the first crank shaft 5 by adjusting the length of the second virtual crank arm, which connects the first crank shaft 5 to the second virtual crank shafts 14*a* and 14*b*. The length of the second virtual crank arm is adjusted by adjusting the revolving radius of the second cylindrical sections 6*b*.

The first and second cylinder head sections 7*c* and 8*c* are respectively attached to front ends of the first and second piston units 7 and 8, and the cylinder heads 25 and 26, which respectively face the first and second cylinder head sections 7*c* and 8*c* and which form the cylinder chambers 27*a*-27*d*, are attached to the main body case 3. In the rotary type cylinder device, the fluid can be introduced into and discharged from the cylinder chambers 27*a*-27*d* by the reciprocal motions of the two piston units. Therefore, the rotary type cylinder device can be applied to variety of driving mechanisms, e.g., hydraulic rotary machines, vacuum sucking machines, internal-combustion engines.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alternations could be made hereto without departing from the spirit and scope of the invention.

What is claimed is:

1. A rotary type cylinder device, which is capable of dealing with interconversion of reciprocating motions of pistons in cylinders and a rotary motion of an input/output shaft (4), comprising:

an input/output shaft (4) being rotated;

a first crank shaft (5) being eccentrically provided with respect to an axis of the input/output shaft (4), the first crank shaft (5) being revolved around the input/output shaft (4) by a first balance weight (9) adapted to function as a first virtual crank arm and having a radius of r from the input/output shaft (4);

an eccentric cylindrical body (6) being constituted by a first cylindrical section (6*a*), to which the first crank shaft (5) is coaxially fitted, and second cylindrical sections (6*b*), whose axes are second virtual crank shafts (14*a*, 14*b*) made eccentric with respect to an axis of the first cylindrical section (6*a*) and which are integrated with the first cylindrical section (6*a*) and located, respectively, on each side of the first cylindrical section (6*a*) in an axial direction;

a first piston unit (7) and a second piston unit (8), in each of which seal caps (17*a*, 17*b*) and seal cap retainers 18*a* 18*b* are integrally attached to piston head sections (7*c*, 8*c*) of piston main bodies (7A, 7B), being crisscrossed with each other and relatively-rotatably attached to the second cylindrical sections (6*b*) of the eccentric cylindrical body (6);

a first balance weight (9) and a second balance weight (10) being adapted to produce rotational balances around the input/output shaft (4), the first balance weight (9) and the second balance weight (10) being respectively provided to both end parts of the first crank shaft (5);

a main body case (3) rotatably holding the input/output shaft (4) which is integrally formed in a least one of the first balance weight (9) and the second balance weight (10), the main body case (3) accommodating the first crank shaft (5), the first balance weight (9) and the second balance weight (10), which are adapted to revolve around the input/output shaft (4), the eccentric cylindrical body (6), which is relatively revolved around the first crank shaft (5), and the first piston unit (7) and the second piston unit (8), which are attached to the eccentric cylindrical body (6);

wherein a composite piston assembly (P) includes the first piston unit (7) and the second piston assembly (8), which are crisscrossed with each other and relatively-rotatably attached to the second cylindrical body (6*b*), and the eccentric cylindrical body (6), which is relatively rotatable, with a second virtual crank arm having a radius r, around the first crank shaft (5);

a first static balance (B1) relating to the first and second piston units (7, 8) around the second virtual crank shafts (14*a*, 14*b*), a second static balance (B2) relating to the composite piston assembly (P) around the first crank shaft (5), and a third static balance (B3) relating to the first crank shaft (5) and the composite piston assembly (P) around the input/output shaft (4) are uniformly produced by only the first balance weight (9) and the second balance weight (10), which are attached to the both end parts of the first crank shaft (5), thereby the first crank shaft (5) is revolved around the input/output shaft (4) and the eccentric cylindrical body (6) is relatively revolved around the first crank shaft (5), so that the first and second piston units (7, 8), which are attached to the second cylindrical sections (6*b*), are linearly reciprocally moved, along a hypocycloid track centered on the input/output shaft (4), in radial directions of a circular orbit of the second virtual crank shafts (14*a*, 14*b*), which has radius of 2*r*, while relatively revolving around the input/output shaft (4).

2. The rotary type cylinder device according to claim 1, wherein first pinholes (5*b*) are formed in both end parts of the first crank shaft (5), respectively, and axes of the pinholes (5*b*) are perpendicular to the axis of the first crank shaft (5), axial holes and second pinholes (9*b*, 10*b*) are formed in shaft sections of the first and second balance weights (9, 10) respectively, axes of the second pinholes (9*b*, 10*b*) of the first and second balance weights (9, 10) are perpendicular to the axes of the first and second balance weights (9, 10), and the both end parts of the first crank shaft (5) are respectively fitted in the axial holes of the first and second balance weights (9, 10) in a state where the first pinholes (5*b*) of the first crank shaft (5) correspond to the second pinholes (9*b*, 10*b*) of the first and second balance weights (9, 10), so as to integrate the first crank shaft (5) with the first and second balance weights (9, 10) by fitting pins (11*a*, 11*b*) into corresponding pairs of the first pin holes (5*b*) and the second pin holes (9*b*, 10*b*), and retaining the pins (11*a*, 11*b*) therein.

3. The rotary type cylinder device according to claim 1, wherein each of the second cylindrical sections (6*b*) has bearing retainer parts (6*c*, 6*d*), which are respectively formed in an inner circumferential face and an outer circumferential face, an inner bearing (15*a*, 15*b*) is retained by the bearing retainer parts (6*c*) formed in the inner circumferential face, an outer bearing (16*a*, 16*b*) is retained by the bearing retainer parts (6*d*) formed in the outer circumferential face, and the first crank shaft (5) is rotatably held by the inner bearings (15*a*, 15*b*), the first and second piston units (7, 8) are held by the outer bearings (16*a*, 16*b*).

* * * * *